US006658761B2

(12) United States Patent
Kishimoto et al.

(10) Patent No.: US 6,658,761 B2
(45) Date of Patent: Dec. 9, 2003

(54) METHOD AND APPARATUS FOR CENTRIFUGALLY DEHYDRATING WORKPIECE

(75) Inventors: Kazuo Kishimoto, Kanazawa (JP); Hiroyuki Nakano, Kanazawa (JP)

(73) Assignee: Shibuya Machinery Co., Ltd., Ishikawa (JP)

( * ) Notice: Subject to any disclaimer, the term of this patent is extended or adjusted under 35 U.S.C. 154(b) by 0 days.

(21) Appl. No.: 10/205,392

(22) Filed: Jul. 26, 2002

(65) Prior Publication Data

US 2003/0029053 A1 Feb. 13, 2003

(30) Foreign Application Priority Data

| | | |
|---|---|---|
| Jul. 26, 2001 | (JP) | 2001-226858 |
| Feb. 12, 2002 | (JP) | 2002-033713 |
| Feb. 12, 2002 | (JP) | 2002-033714 |
| Feb. 12, 2002 | (JP) | 2002-033715 |

(51) Int. Cl.[7] ..... F26B 5/08

(52) U.S. Cl. ..... 34/312; 34/58; 34/312; 34/313; 34/328

(58) Field of Search ..... 34/312, 313, 317, 34/328, 58, 59, 60, 61, 69; 210/360.1, 380.1, 380.2, 380.3; 99/302 C; 134/149, 902

(56) References Cited

U.S. PATENT DOCUMENTS

| | | | | |
|---|---|---|---|---|
| 4,161,356 A | * | 7/1979 | Giffin et al. | 354/323 |
| 5,104,682 A | * | 4/1992 | Nakahama et al. | 427/27 |
| 5,458,249 A | * | 10/1995 | Shang-Lu | 211/197 |
| 6,185,834 B1 | * | 2/2001 | Yang | 34/58 |

FOREIGN PATENT DOCUMENTS

| | | |
|---|---|---|
| JP | 6-52973 | 7/1994 |

* cited by examiner

*Primary Examiner*—Ira S. Lazarus
*Assistant Examiner*—Camtu Nguyen
(74) *Attorney, Agent, or Firm*—Sughrue Mion, PLLC

(57) ABSTRACT

In a method for centrifugally dehydrating a pallet or the like, the pallet or the like is held on a diagonal line thereof, and is rotated in a state where the diagonal line is substantially aligned with an axis of rotation, thereby removing a liquid adhered thereto.

10 Claims, 22 Drawing Sheets

METHOD AND APPARATUS FOR CENTRIFUGALLY DEHYDRATING WORKPIECE

The present application is based on Japanese Patent Applications Nos. 2001-135638, 2001-226858, 2002-33713, 2002-33714 and 2002-33715, which are incorporated herein by reference.

BACKGROUND OF THE INVENTION

1. Field of the Invention

The present invention relates to a centrifugal dehydrating technology for removing a liquid such as a cleaning liquid adhered to a workpiece with a substantially rectangular plane (hereafter referred to also as a pallet or the like) such as a pallet or a tray or container similar thereto by the action of a centrifugal force.

2. Description of the Related Art

Conventionally, in a case where a pallet or the like formed of a resin is centrifugally dehydrated, it has been the general practice to effect centrifugal dehydration in a horizontal state in a state in which the pallet or the like is being conveyed on a conveyor. However, there are many cases where the pallet or the like is provided with a multiplicity of ribs to increase the strength, and a multiplicity of recessed portions are formed by those ribs, so that the actual situation has been such that the cleaning liquid gathered in the recessed portions cannot be easily removed even if centrifugal dehydration is performed. Accordingly, concerning the centrifugal dehydration of the pallet, a technique has been disclosed in which the pallet is rotated in an upright state (Japanese Utility Model Publication No. Hei. 6-52973). In this case, the cleaning liquid remaining in the recessed portions can be removed efficiently. However, in the case of this conventional technique, the center is liable to be offset at the time of holding the pallet, so that there has been a problem in that if the pallet is rotated as it is, the pallet becomes unstable due to an imbalance; and there is a large danger. Due to these circumstances, the holder has tended to be complex and large in size so as to hold the pallet securely. In addition, the types of pallets are very numerous, and it has been difficult to jointly use the same apparatus for the pallets of different sizes.

SUMMARY OF THE INVENTION

The present invention has been devised in view of the above-described conventional technical situation, and its object is to provide a centrifugal dehydration apparatus for a pallet or the like which, at the time of holding the pallet or the like, makes it possible to easily locate the center of gravity of the pallet or the like on the axis of rotation and is capable of easily suppressing the runout due to the centrifugal force.

In the invention, to overcome the above-described problems, a workpiece with a substantially rectangular plane is held an a diagonal line of its substantially rectangular plane by a pair of holders which are rotated by a rotator, and the diagonal line of the workpiece is aligned with an axis of rotation. Since the center of gravity of the workpiece is generally located on its diagonal line, the center of gravity of the workpiece is located on the axis of rotation according to the above-described structure. Accordingly, in accordance with the invention, it is possible to easily suppress the runout due to the centrifugal force. It should be noted that the alignment of the diagonal line of the workpiece with the axis of rotation, which is referred to herein, is not to be construed in a strict sense, and it suffices if it is possible to suppress the runout due to the centrifugal force to such an extent as to cause no hindrance by obviating an imbalance in rotation by substantially aligning the diagonal line of the workpiece with the axis of rotation. If the pair of corner portions of the workpiece are held on its diagonal line by the pair of holders, the diagonal line of the workpiece can be easily aligned with the axis of rotation. It should be noted that the direction of rotation of the workpiece may be changed over between forward rotation and reverse rotation, or the frequency of changeover may be set to two times or more. In addition, after the workpiece is subjected to cleaning in an upright state such that one edge thereof is set as a bottom, the workpiece may be tilted such that a corner portion thereof is set as a bottom, and centrifugal dehydration may be effected in the tilted state. Furthermore, the pair of holders may be each arranged to be capable of tilting in correspondence with abutment against two adjacent edge portions with each of the corner portions located therebetween when the pair of corner portions of the workpiece are respectively held by the pair of holders, and there may be further provided a supporting mechanism for supporting the two edge portions with the corner portion of a bottom of the workpiece located therebetween and a transfer mechanism for transferring the supporting mechanism.

Incidentally, the present invention may be employed to centrifugally dehydrate a planar workpiece such as a planar pallet, however, the shape of the workpiece is not limited to this. For example, the shape of the workpiece may be rectangular solid, cube, or the like. "A workpiece with a substantially rectangular plane" may be a workpiece having a contour with a substantially rectangular plane viewed from at least one direction. This type of workpiece has at least a pair of corner portions to be held when dehydrated.

Features and advantages of the invention will be evident from the following detailed description of the preferred embodiments described in conjunction with the attached drawings.

DETAILED DESCRIPTION OF THE PREFERRED EMBODIMENTS

Figure 1:
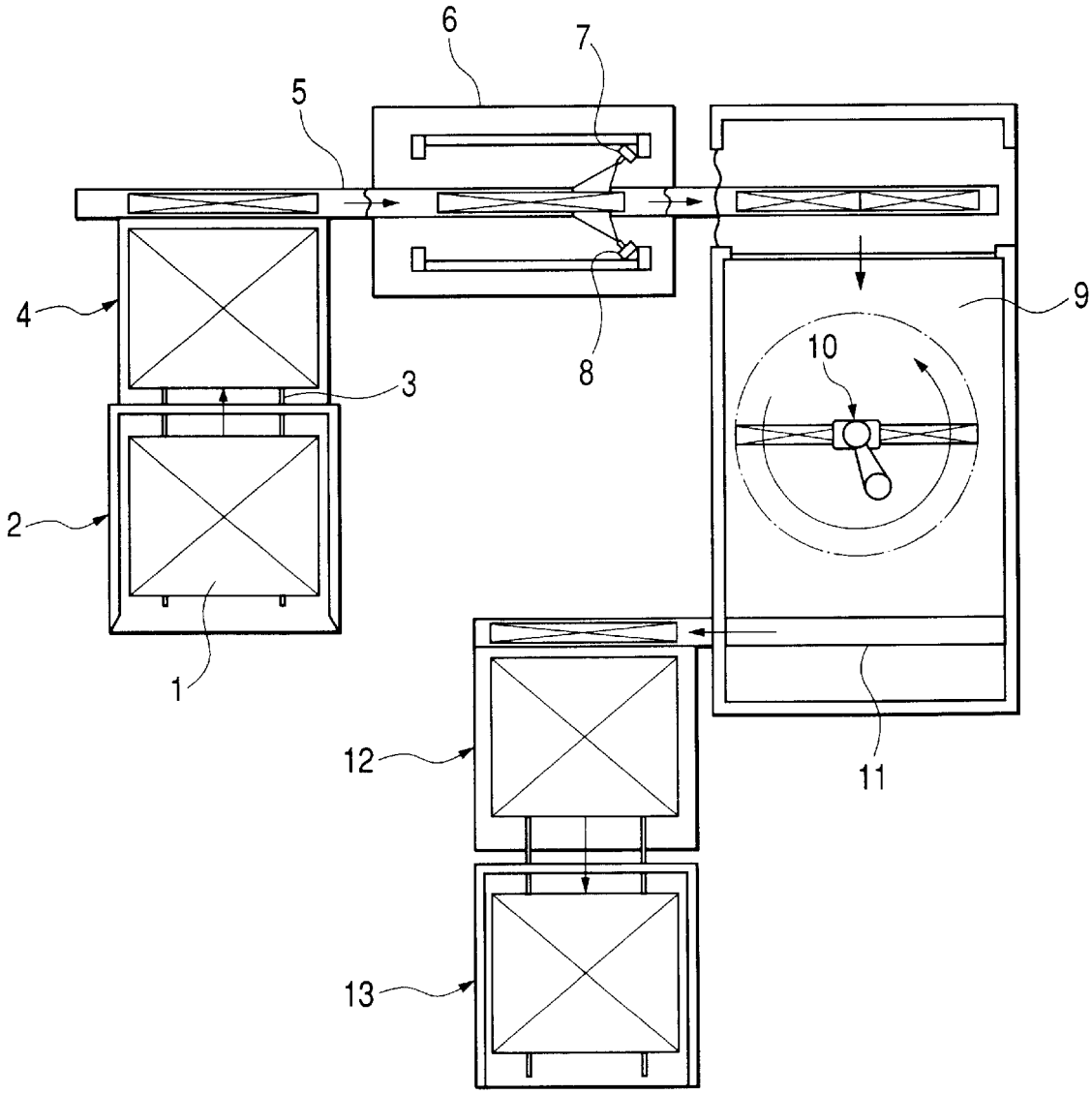
FIG. 1 is a schematic diagram illustrating a layout concerning essential portions of an embodiment in accordance with the invention.

Referring now to the drawings, a description will be given of an embodiment of the invention. FIG. 1 is a schematic layout drawing illustrating a layout concerning essential portions of an embodiment in accordance with the invention. Pallets 1 as workpieces are accommodated in a magazine 2 in a horizontally stacked state, and are conveyed to setting-up means 4 one by one through a discharge conveyor 3. The pallet 1 conveyed to the setting-up means 4 is made set up such that a mounted surface becomes vertical with its one edge as a bottom, and is mounted on a carrying-in conveyor 5 in an upright state. The pallet 1 mounted on the carrying-in conveyor 5 is conveyed to a cleaning chamber 6 in the upright state, and the cleaning of the pallet 1 is effected as a cleaning fluid is sprayed to its both obverse and reverse surfaces through cleaning nozzles 7 and 8 serving as cleaning means disposed movably on both sides of the cleaning chamber 6. Further, the respective side surfaces of the pallet 1 are also cleaned by using the cleaning nozzles 7 and 8 and unillustrated other cleaning nozzles. It should be noted that, in the conveyance of the pallet 1 to the cleaning chamber 6; irrespective of its size and shape, the pallet 1 is stopped such that a foremost portion of the pallet 1 is aligned with a reference position, and cleaning processing is carried out as the cleaning nozzles 7 and 8 are lowered from an upper edge portion while being reciprocally moved back and forth, for instance, by using the reference position as a reference. Further, it is possible to adopt a form in which cleaning is effected by vertically moving the cleaning nozzles 7 and 8 while the pallet 1 is being conveyed by the carrying-in conveyor 5 without being stopped. As the cleaning liquid, it is possible to use tap water, tap water with a detergent added thereto, a gas-liquid mixed solution in which a gas is mixed in a liquid, or in a case where the contamination is heavy, a liquid in which a cleaning liquid is heated or a liquid in which a particulate substance is mixed. In addition, it is possible to adopt a form in which rinsing cleaning is added after cleaning by a detergent. After cleaning, the cleaned pallet 1 as it is in the upright state is conveyed to a dehydration chamber 9. The pallet 1 conveyed to the dehydration chamber 9 is tilted with its one corner as a bottom by a tilting means (which will be described later) when the pallet 1 is lifted up from the carrying-in conveyor 5. The pallet 1 as it is in the tilted state is transferred to a centrifugal dehydration means 10, and liquid drops adhered to the pallet 1 are subjected to centrifugal dehydration. Upon completion of the centrifugal dehydration, the pallet 1 as it is in the tilted state is conveyed to a carrying-out conveyor 11, and after its tilted state is restored to the upright state with its one edge as a bottom, the pallet 1 mounted on the carrying-out conveyor 11. The pallet 1 after being subjected to centrifugal dehydration and mounted on the carrying-out conveyor 11 is conveyed as it is in the upright state to an inverting means 12. After being inverted to a horizontal state by the inverting means 12, the pallets 1 are carried out in a stacked state or one by one by means of a pallet stocker 13 or the like. It should be noted that, in terms of the form of their use, the setting-up means 4 and the inverting means 12 differ from each other in that the pallet 1 in the horizontal state is made set up or the pallet 1 in the upright state is inverted to the horizontal state, but similar mechanisms are used as inverting mechanisms.

Incidentally, the planar pallet 1 is dehydrated according to the embodiment, however, a workpiece to be dehydrated is not limited to this. For example, the shape of the workpiece may be rectangular solid, cube, or the like. In the workpiece, a multiplicity of ribs and a multiplicity of recessed portions are provided.

Figure 2:
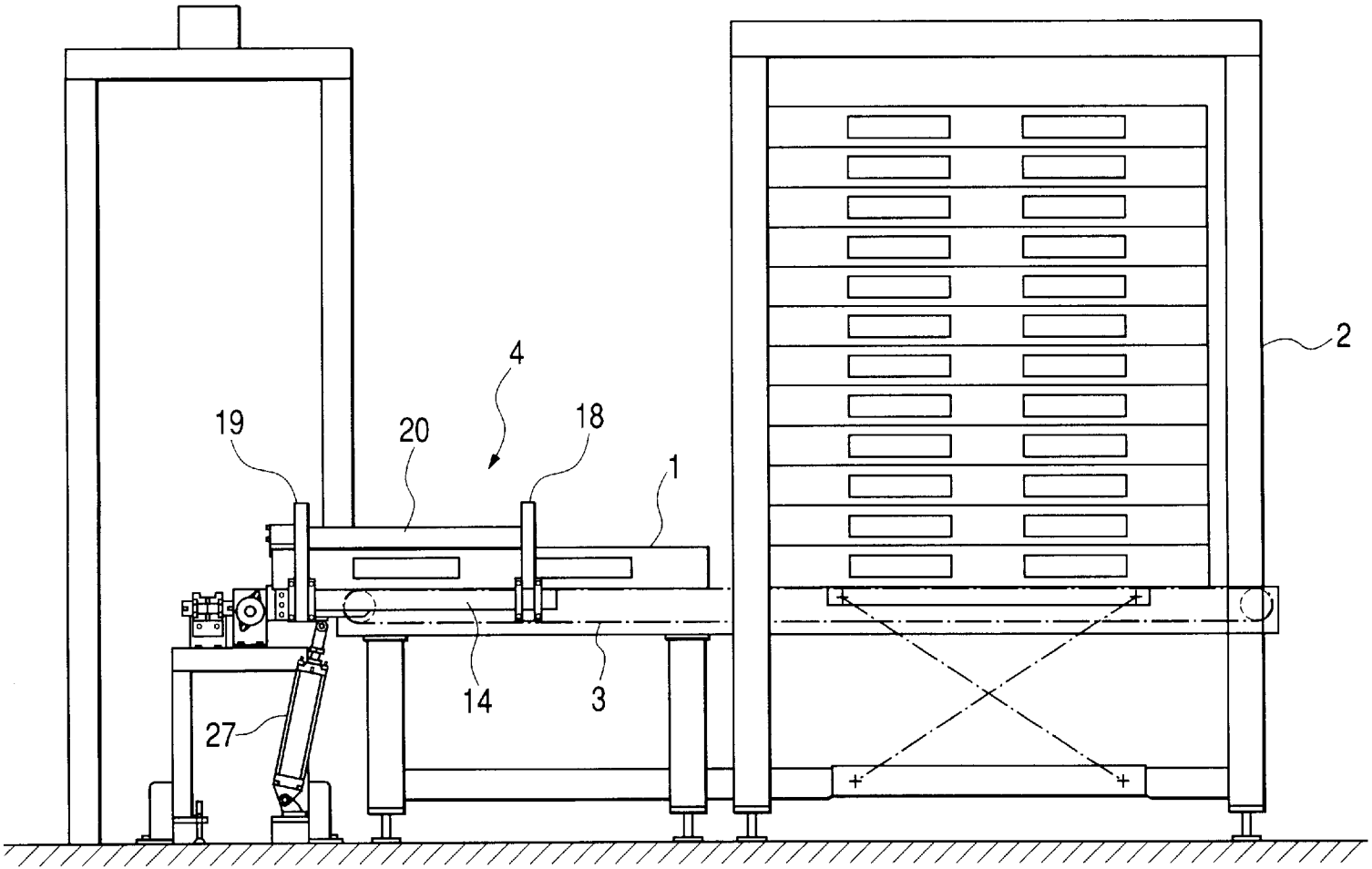
FIG. 2 is a front elevational view illustrating the portion of setting-up means for setting up a pallet.
Figure 3:
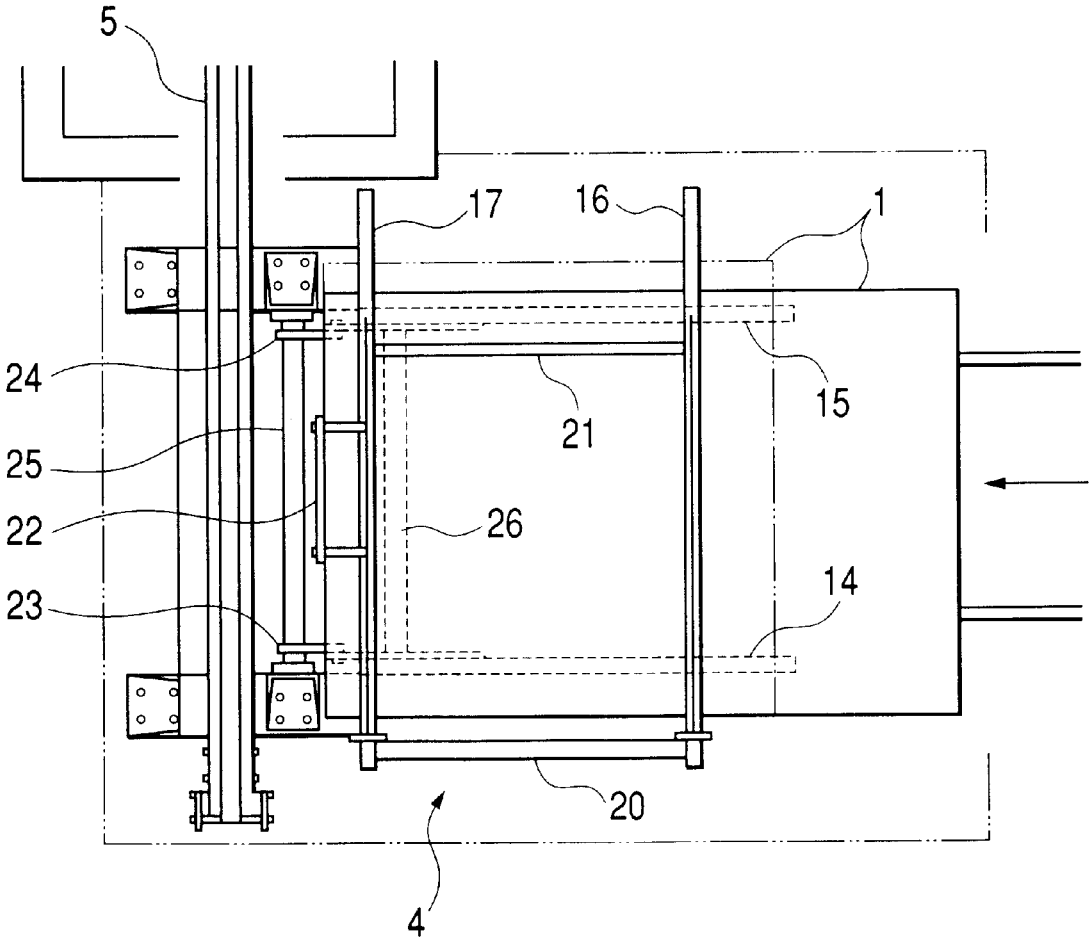
FIG. 3 is a plan view illustrating the portion of the setting-up means.
Figure 4:
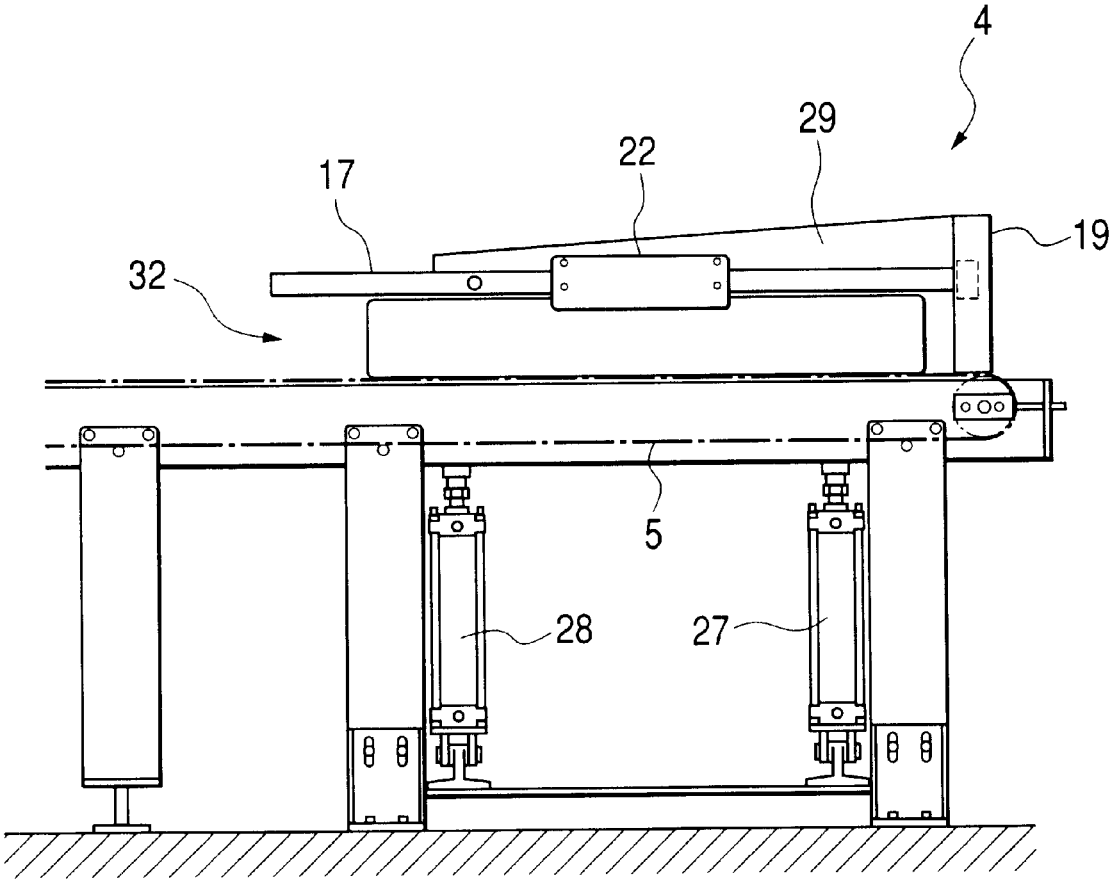
FIG. 4 is a left side elevational view illustrating the portion of the setting-up means.
Figure 5:
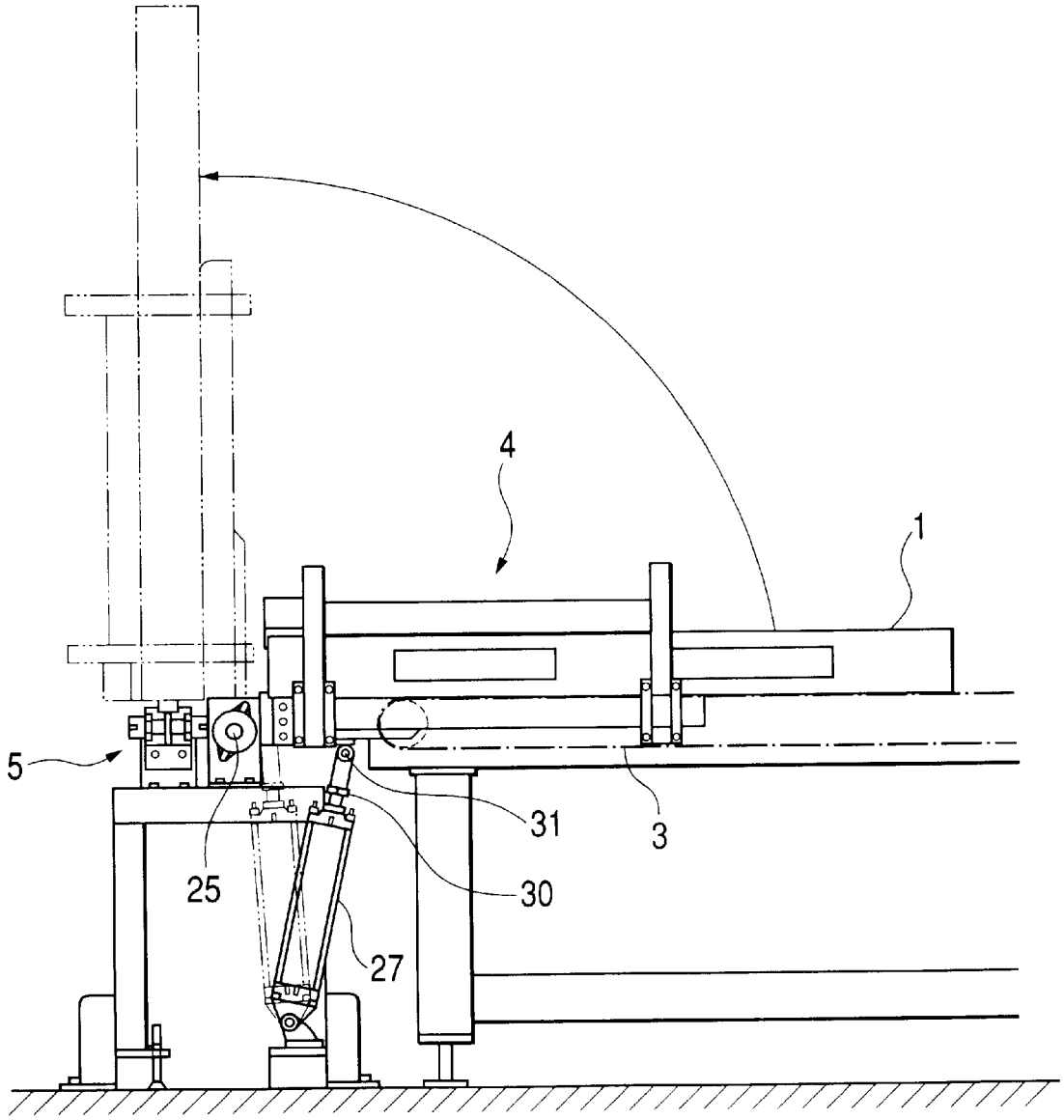
FIG. 5 is a partial enlarged view illustrating the setting-up means.

Next, a description will be given of the respective above-described component parts. First, a description will be given of the aforementioned setting-up means 4. FIG. 2 is a front elevational view illustrating the portion of the setting-up means 4, FIG. 3 is a plan view, FIG. 4 is a left side elevational view, and FIG. 5 is a partial enlarged view thereof. The setting-up means 4 comprises as its principal elements lower-portion supporting members 14 and 15 spaced apart in parallel for supporting the underside of the pallet 1 as well as upper-portion supporting members 16 and 17 spaced apart in parallel in a direction perpendicular to the lower-portion holding members 14 and 15. The arrangement provided is such that each of the pallets 1 conveyed one by one from the magazine 2 is inserted between the lower-portion holding members 14 and 15, on the one hand, and the upper-portion supporting members 16 and 17, on the other hand, and is set up. The upper-portion supporting members 16 and 17 are connected and fixed to the lower-portion holding members 14 and 15 by means of connecting members 18 and 19 in a state in which an interval allowing the pallet 1 to be inserted is provided therebetween. The upper-portion supporting members 16 and 17 are connected to each other by connecting members 20 and 21. In addition, a retaining plate 22 is attached to the upper-portion supporting member 17, and a lower end of the retaining plate 22 is set so as to jut out into, an insertion space for the pallet 1, as shown in FIG. 4, in order to retain an end face of the pallet 1. As shown in FIG. 3, the lower-portion holding members 14 and 15 are pivotally secured to a supporting shaft 25 by means of supporting plates 23 and 24, respectively. In addition, the lower-portion holding members 14 and 15 are connected and fixed to each other by a connecting member 26, and cylinders 27 and 28 for driving are installed at appropriate positions on the lower-portion holding members 14 and 15 or the connecting member 26. It should be noted that reference numeral 29 in FIG. 4 denotes a reinforcing plate disposed between the connecting members 18 and 19, on the one hand, and the upper-portion supporting members 16 and 17, on the other hand.

As shown in FIG. 3, the discharge conveyor 3 extends to a position below the setting-up means 4 and is disposed so as to be located between the lower-portion holding members 14 and 15. As such, when the pallets 1 accommodated in the magazine 2 are conveyed one by one to the setting-up means 4 by means of the discharge conveyor 3, the pallet 1 is inserted between the lower-portion holding members 14 and 15, on the one hand, and the upper-portion supporting members 16 and 17, on the other hand, and a leading end portion in the advancing direction is retained by the retaining plate 22 and stops at its home position. Subsequently, as shown in the partial enlarged view in FIG. 5, if the cylinders 27 and 28 are driven to cause their output shafts 30 to project, the lower-portion holding members 14 and 15 are rotated upward about the supporting shaft 25 through connecting pins. 31. Consequently, the pallet 1 inserted between the lower-portion holding members 14 and 15 and the upper-portion supporting members 16 and 17 is set up on the carrying-in conveyor 5 in a state in which one edge on the side retained by the retaining plate 22 is set as its bottom. Then, the pallet 1 mounted on the carrying-in conveyor 5 in the upright state is moved out from a gap portion 32 formed on the side of distal end portions of the upper-portion supporting members 16 and 17, as shown in FIG. 4, and is conveyed as it is in the upright state to the cleaning chamber 6. In the cleaning chamber 6, a cleaning liquid is sprayed onto both obverse and reverse surfaces from the cleaning nozzles 7 and 8 disposed movably on both sides of the cleaning chamber 6, thereby effecting cleaning. Subsequently, the pallet 1 is conveyed as it is in the upright state from the cleaning chamber 6 to the dehydration chamber 9. At the time of this conveyance, the lower-portion holding members 14 and 15 and the upper-portion supporting members 16 and 17 function as guides and prevents the tilting down of the pallet 1. In addition, the pallet insertion interval formed between the upper-portion supporting members 16 and 17 and the lower-portion holding members 14 and 15 is made to be used jointly for varying sizes of the pallets 1, and permits to set up all the subject pallets. It should be noted that sealing means is provided at an inlet and an outlet of the cleaning chamber 6, as required, so as to prevent the scattering of the cleaning liquid to the outside.

Figure 6:
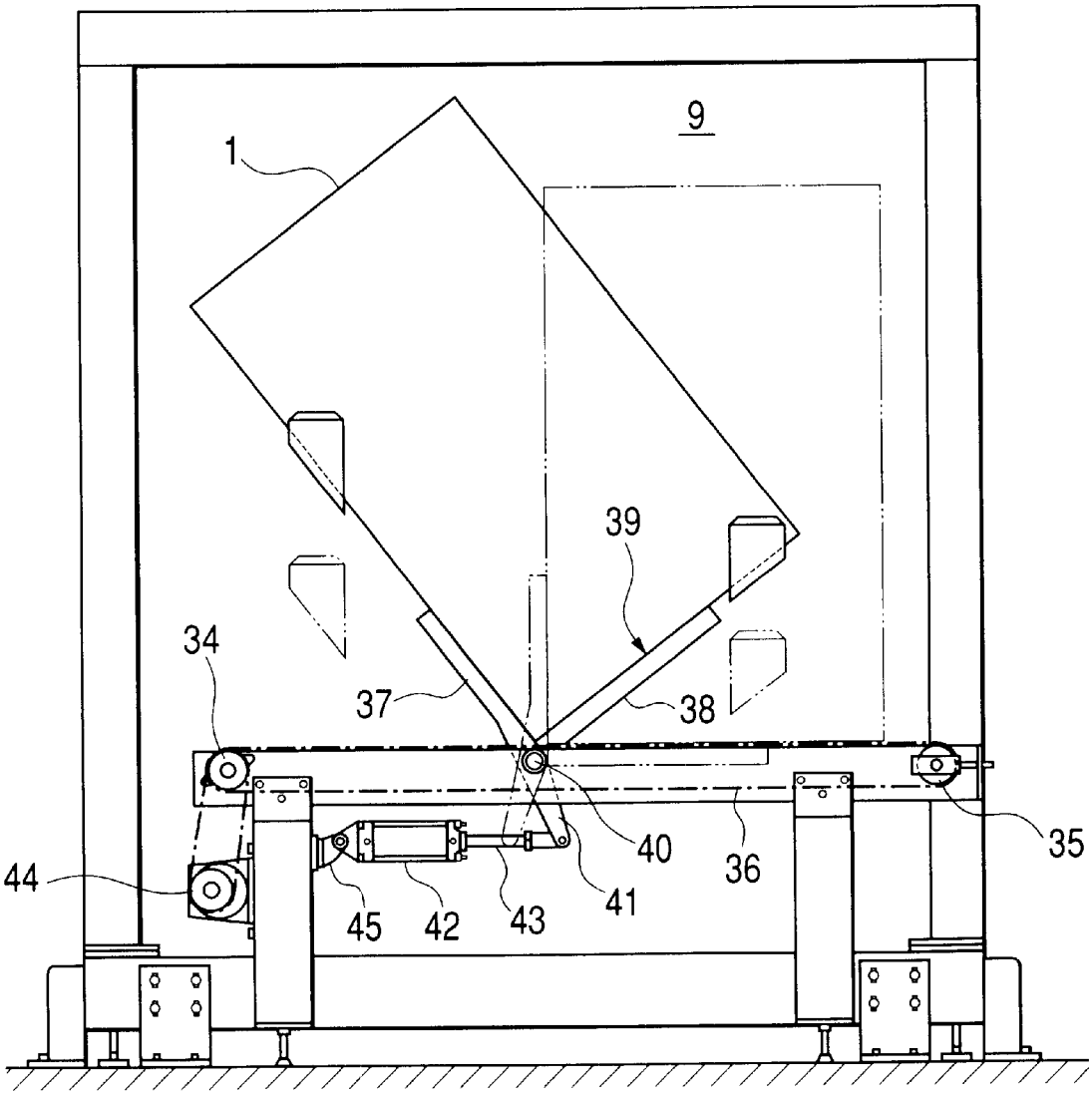
FIG. 6 is a front elevational view illustrating the portion of a tilting means for tilting the pallet.
Figure 7:
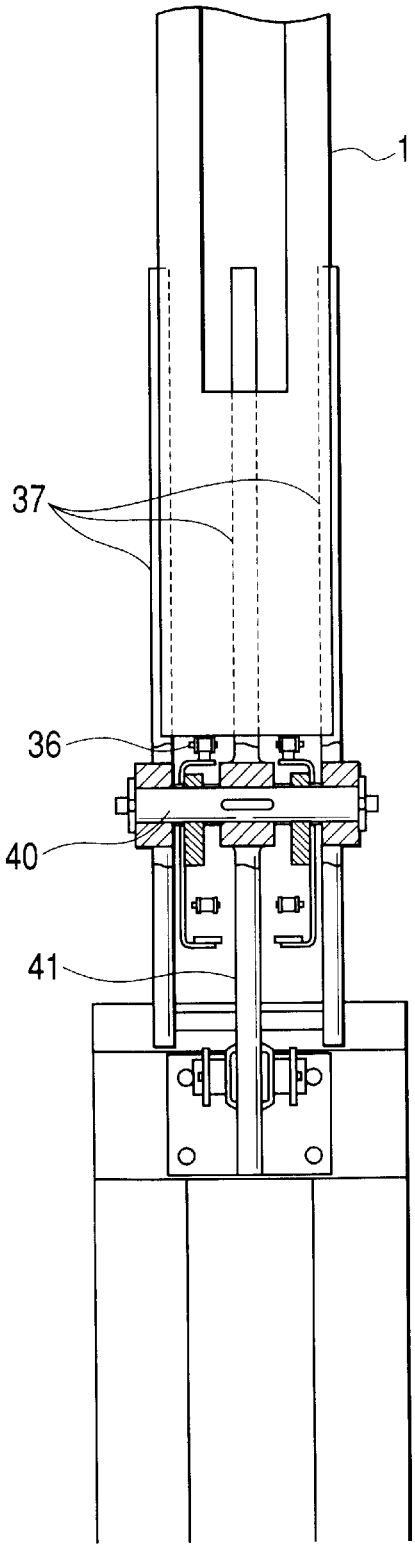
FIG. 7 is a partial enlarged side elevational view illustrating the tilting means.

Next, a description will be given of a tilting means for tilting the pallet 1 by using one corner as a bottom when the pallet 1 conveyed to the dehydration chamber 9 is lifted up from the carrying-in conveyor 5, as well as a first transfer mechanism for transferring the pallet 1 as it is in the tilted state to the centrifugal dehydration means 10 and a second transfer mechanism for transferring the dehydrated pallet 1 as it is in the tilted state from the centrifugal dehydration means 10 to the carrying-out conveyor 11 for carrying out. FIG. 6 is a front elevational view illustrating the tilting means for tilting the pallet 1, FIG. 7 is a partial enlarged side elevational view thereof. As shown in FIG. 6, disposed at a predetermined position on the conveying surface of a chain conveyor 36 having, for example, two endless chains juxtaposed and trained between a pair of sprockets 34 and 35 for making up the carrying-in conveyor 5 is a tilting means 39 having a retaining portion 37 by which a front end portion of the pallet 1 conveyed by the chain conveyor 36 and a lower-edge supporting portion 38 formed integrally with and perpendicularly to the retaining portion 37 to support the lower edge of the pallet 1. This tilting means 39 rotatably supports the pallet 1 by a supporting shaft 40 so as not to interfere with the motion of the chain conveyor 36, and a distal end of its drive arm 41 is rotatably connected to an output shaft 43 of a cylinder 42 for driving. As such, when the pallet 1 being conveyed on the conveying surface of the chain conveyor 36 reaches the portion of the tilting means 39, its leading end portion is first retained by the retaining portion 37 indicated by the two-dot chain line and the pallet 1 stops. Subsequently, as the cylinder 42 is driven at an appropriate timing to forwardly advance the output shaft 43, and the tilting means 39 is thereby rotated about the supporting shaft 40, it is possible to tilt the pallet 1 as indicated by the solid lines. At the time of this tilting, the cleaning liquid adhered to the pallet 1 drops down. In addition, since one corner of the pallet 1 is supported by this tilting means 39, a model change due to a change of shape such as the size of the pallet 1 is not required, so that the joint use of the tilting means 39 can be made. It should be noted that, in the above process, when the pallet 1 has approached the retaining portion 37, the arrival may be detected by a sensor, as required, and the chain conveyor 36 may be decelerated. In addition, the chain conveyor 36 may be stopped by adjusting its timing to the timing when the pallet 1 is retained by the retaining portion 37 and stops. Alternatively, the chain conveyor 36 may be stopped after the rotation of the tilting mechanism 39, or may be kept in a constantly driven state for conveying an ensuing pallet 1. In the drawings, reference numeral 44 denotes a drive motor for driving the chain conveyor 36, and 45 denotes a supporting portion for rotatably supporting the cylinder 42.

Figure 8:
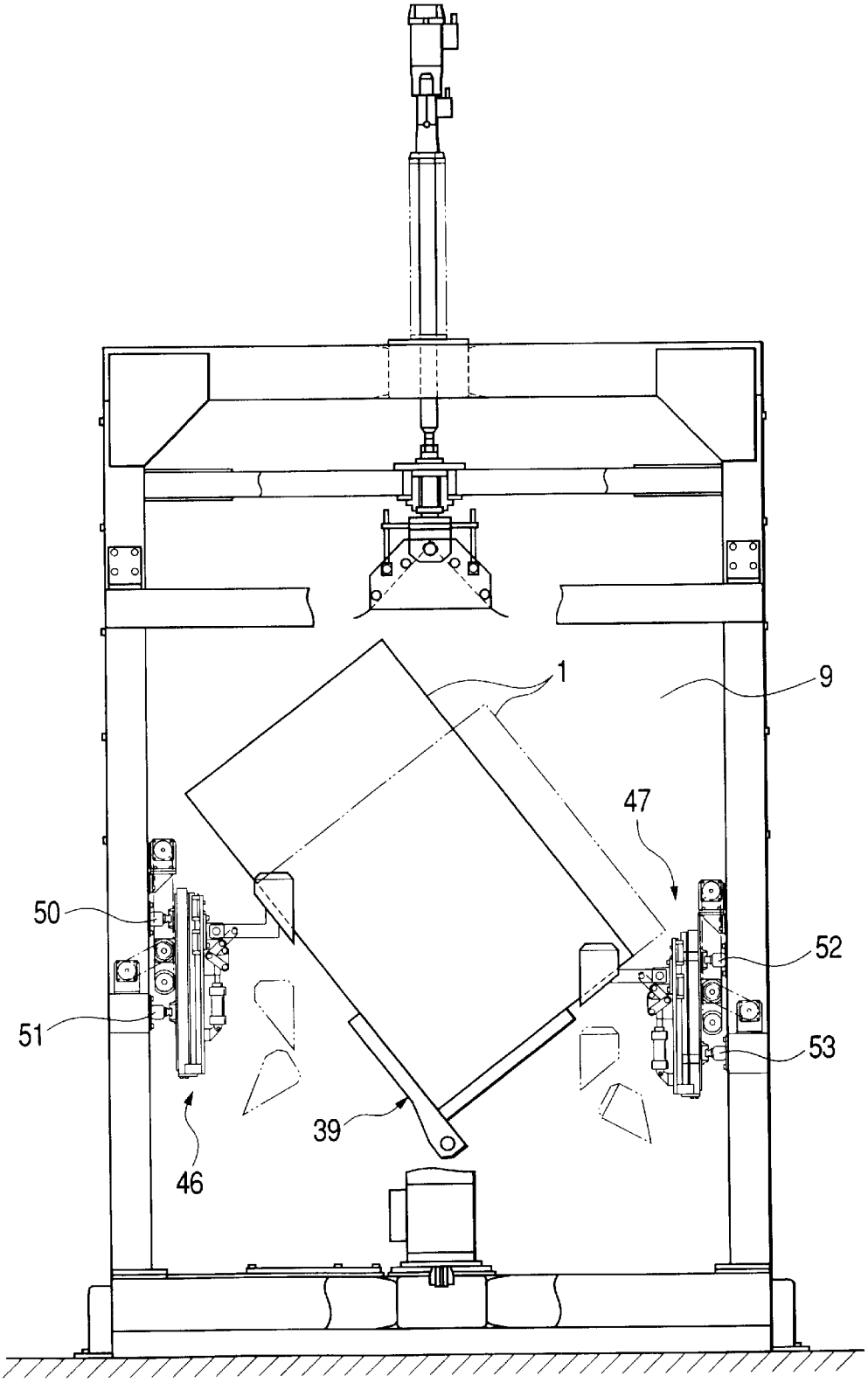
FIG. 8 is a front elevational view illustrating an internal structure of a dehydration chamber.
Figure 9:
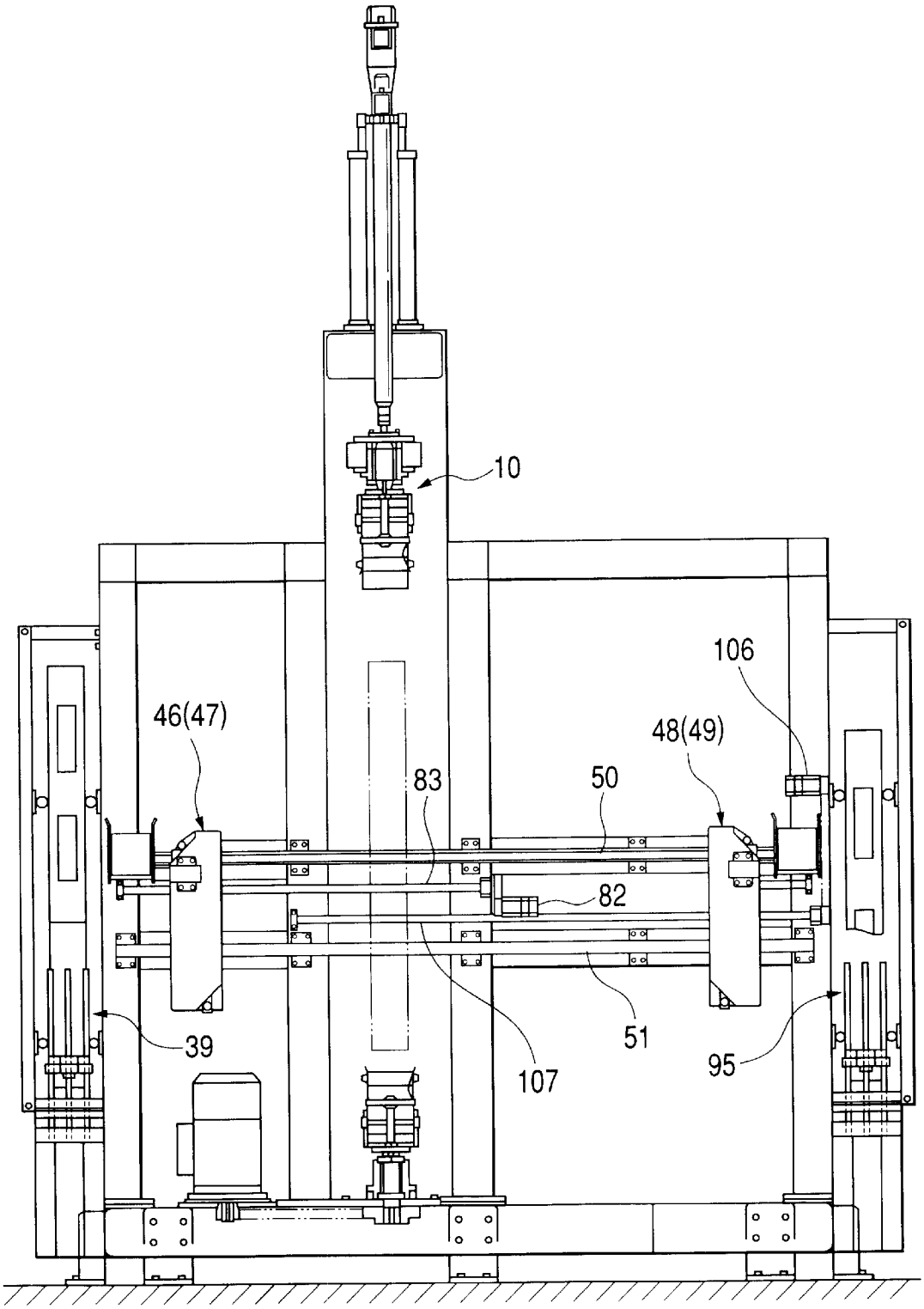
FIG. 9 is a side elevational view illustrating the internal structure as viewed from the center of the dehydration chamber.

FIG. 8 is a front elevational view illustrating an internal structure of the dehydration chamber 9, and FIG. 9 is a side elevational view illustrating the internal structure as viewed from the center of the dehydration chamber 9. In this embodiment, as shown in FIG. 8, a pair of transfer mechanisms 46 and 47 making up the first transfer mechanism for lifting up the pallet 1 mounted on the tilting means 39 and set in the tilted state and for transporting the pallet 1 as it is in the tilted state to the centrifugal dehydration means 10 are disposed in both side portions on this side of the dehydration chamber 9. In addition, as shown in FIG. 9, disposed on both side portions in the rear of the dehydration chamber 9 are a pair of transfer mechanisms 48 and 49 making up the second transfer mechanism for lifting up the pallet 1 for which dehydration processing by the centrifugal dehydration means 10 has been completed and which is in the tilted state, and for transferring the pallet 1 as it is in the tilted state to a tilt restoring means for restoring the pallet 1 disposed on the carrying-out conveyor 11 side from the tilted state to the horizontal state. It should be noted that the transfer mechanisms 46 and 47 making up the first transfer mechanism and the transfer mechanisms 48 and 49 making up the second transfer mechanism are arranged to move while being by supported and guided by upper and lower rails 50 to 53 laid horizontally on both side portions, respectively. In addition, as shown in FIG. 8, the installation height of the one transfer mechanisms 46 and 48 is set to be higher than the other transfer mechanisms 47 and 49.

Figure 10:
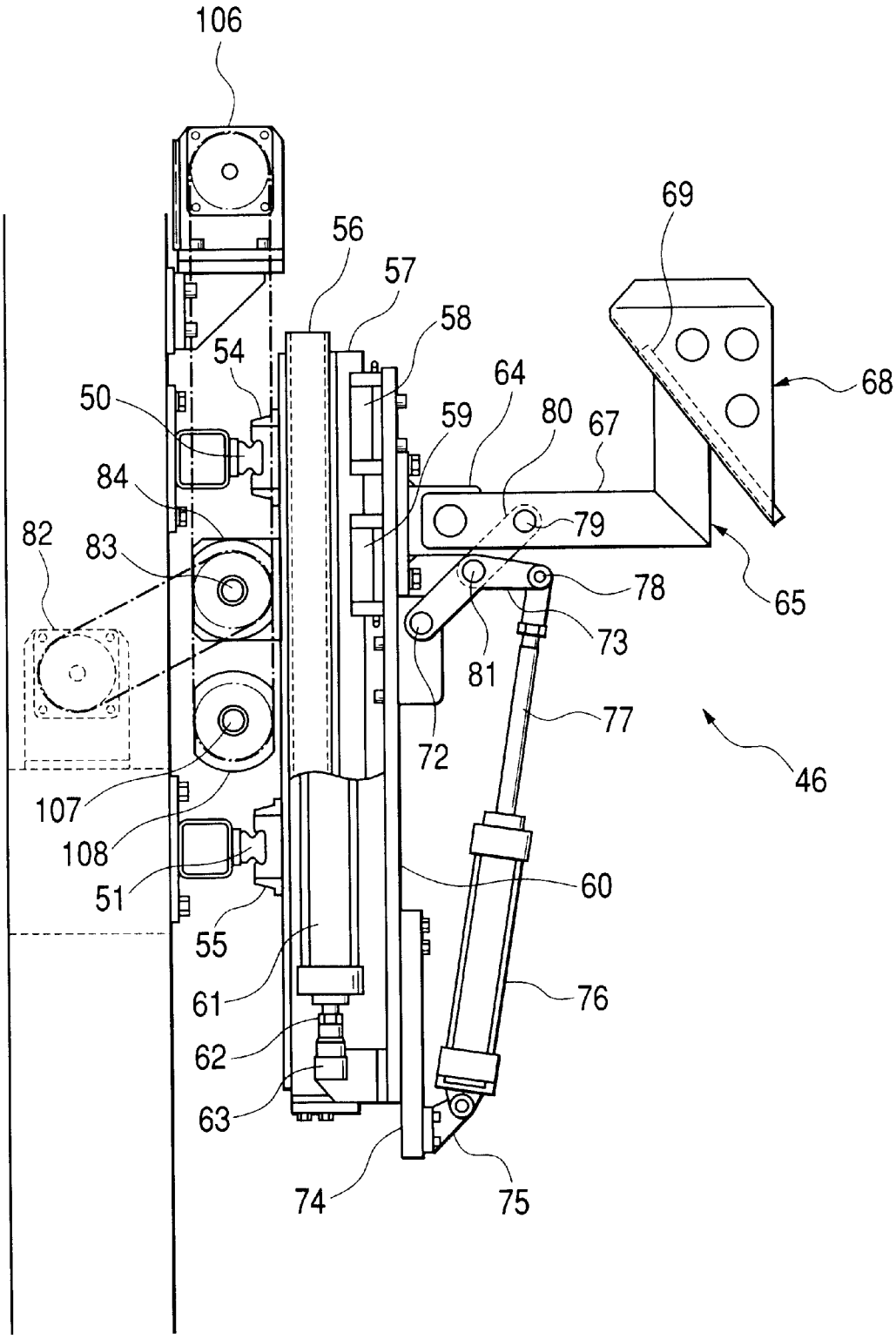
FIG. 10 is an enlarged front elevational view of one transfer mechanism for making up a first transfer mechanism.
Figure 11:
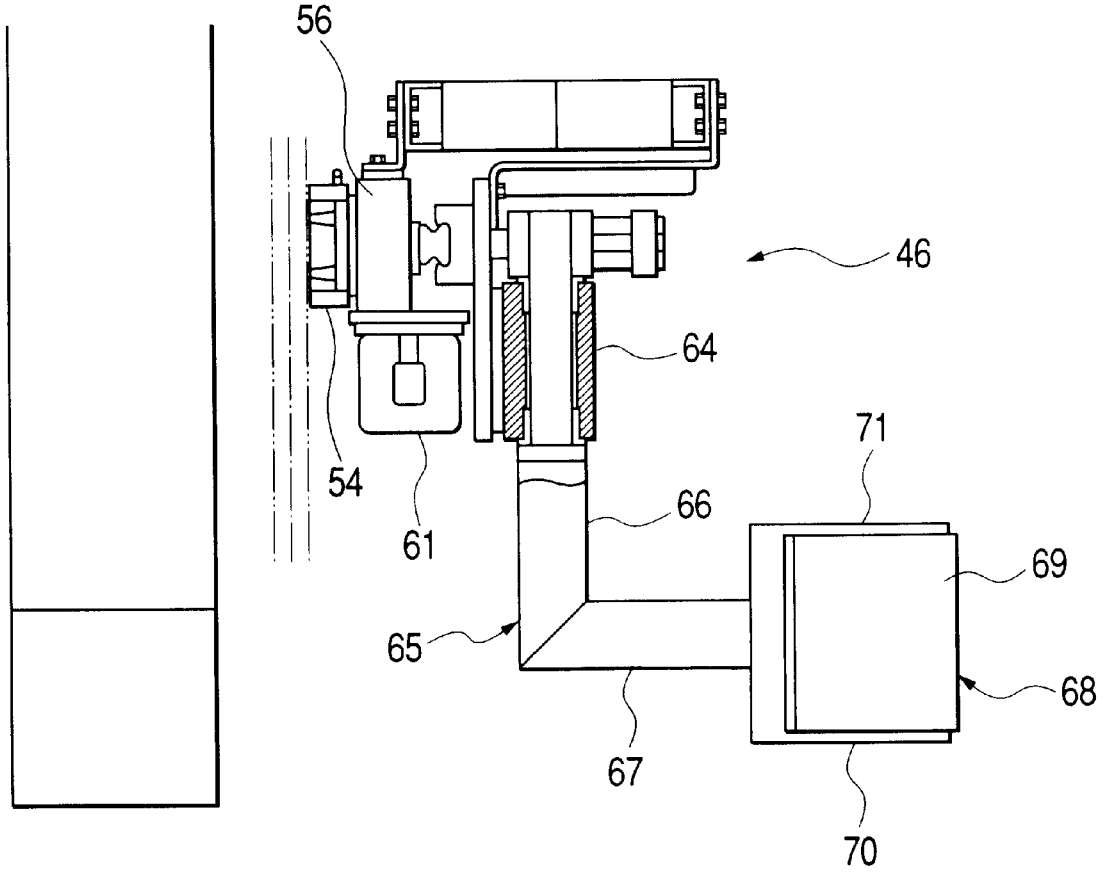
FIG. 11 is a plan view thereof.
Figure 12:
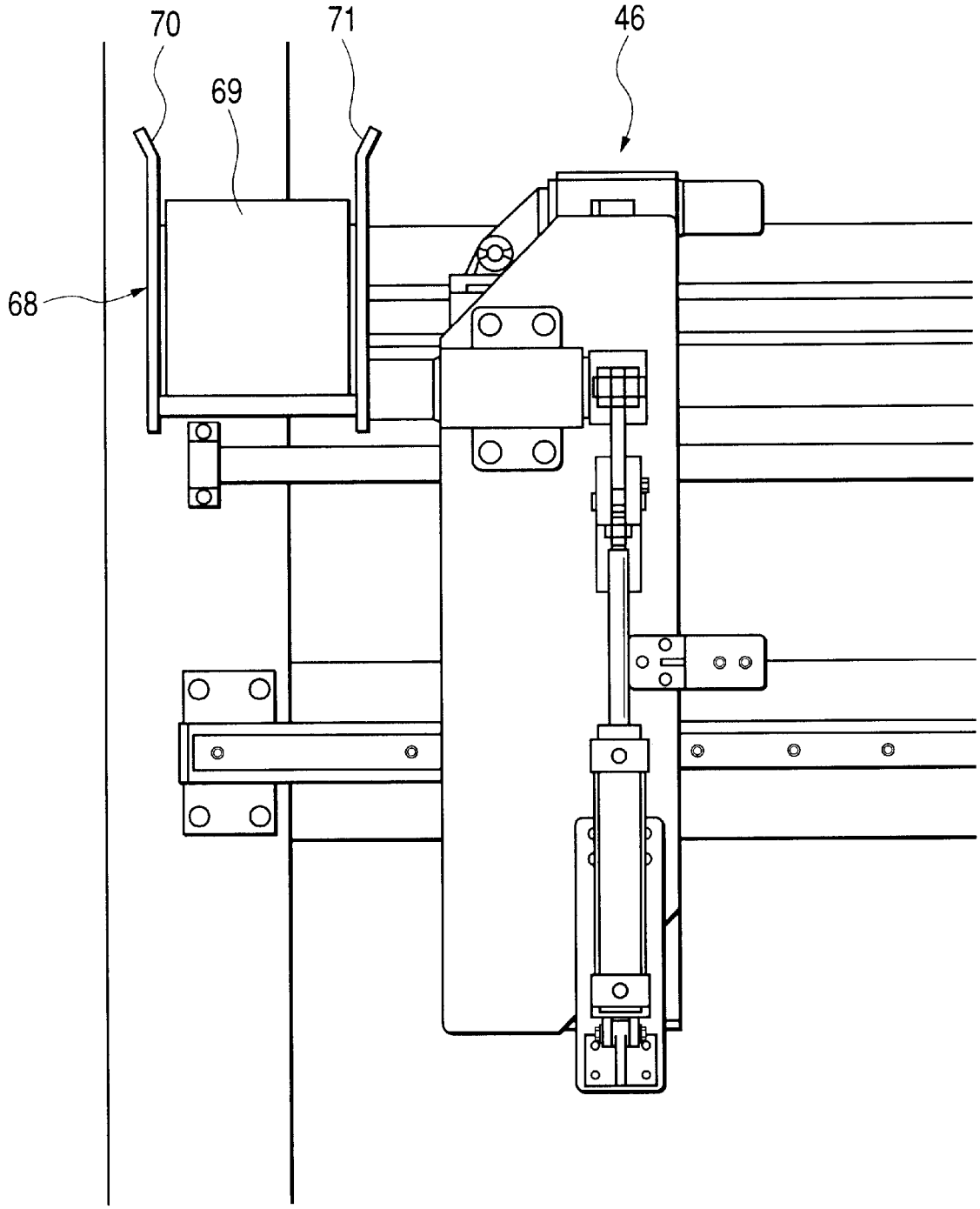
FIG. 12 is a side elevational view thereof.
Figure 13:
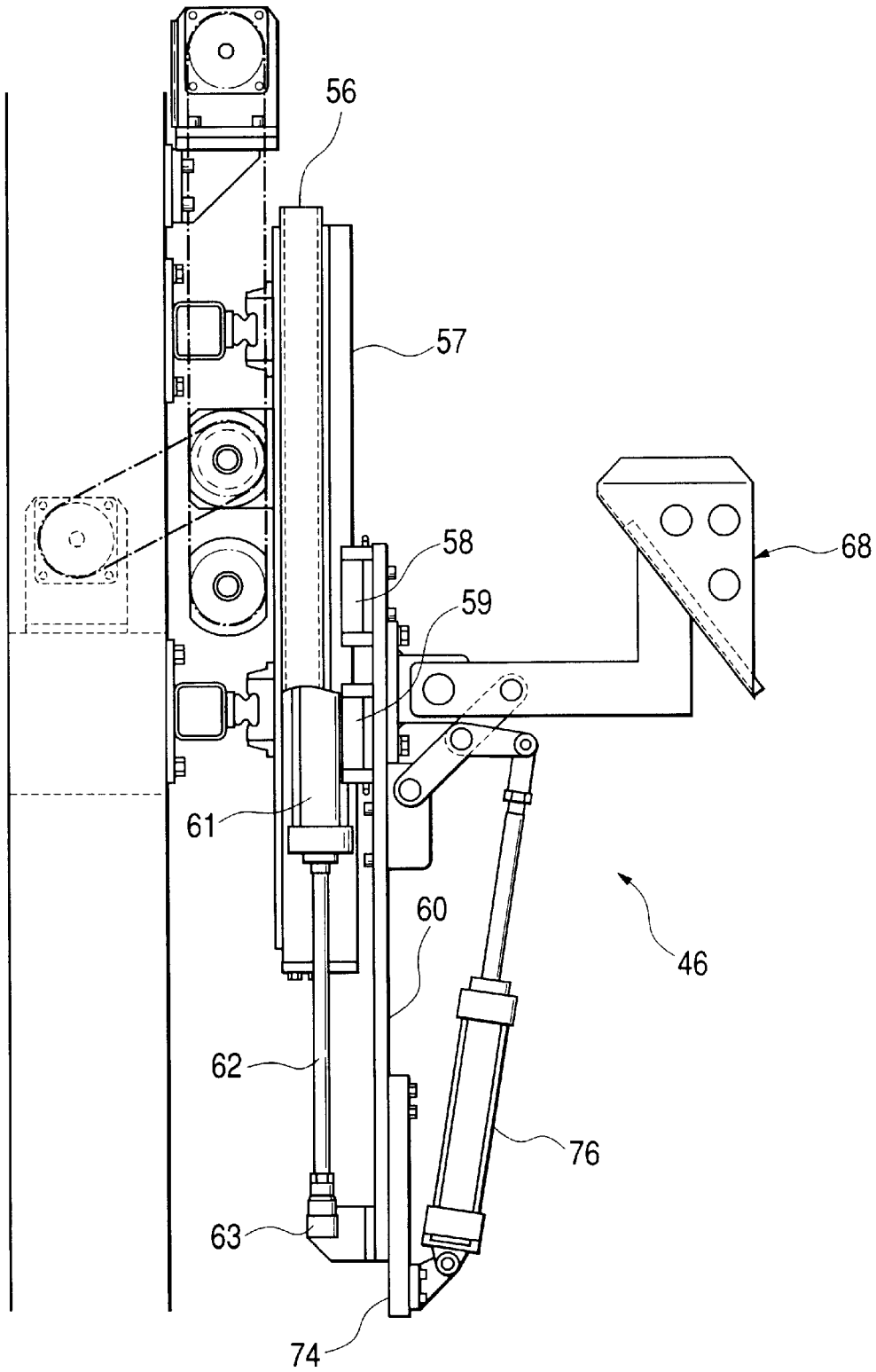
FIG. 13 is a front elevational view illustrating another operating state of the transfer mechanism.
Figure 14:
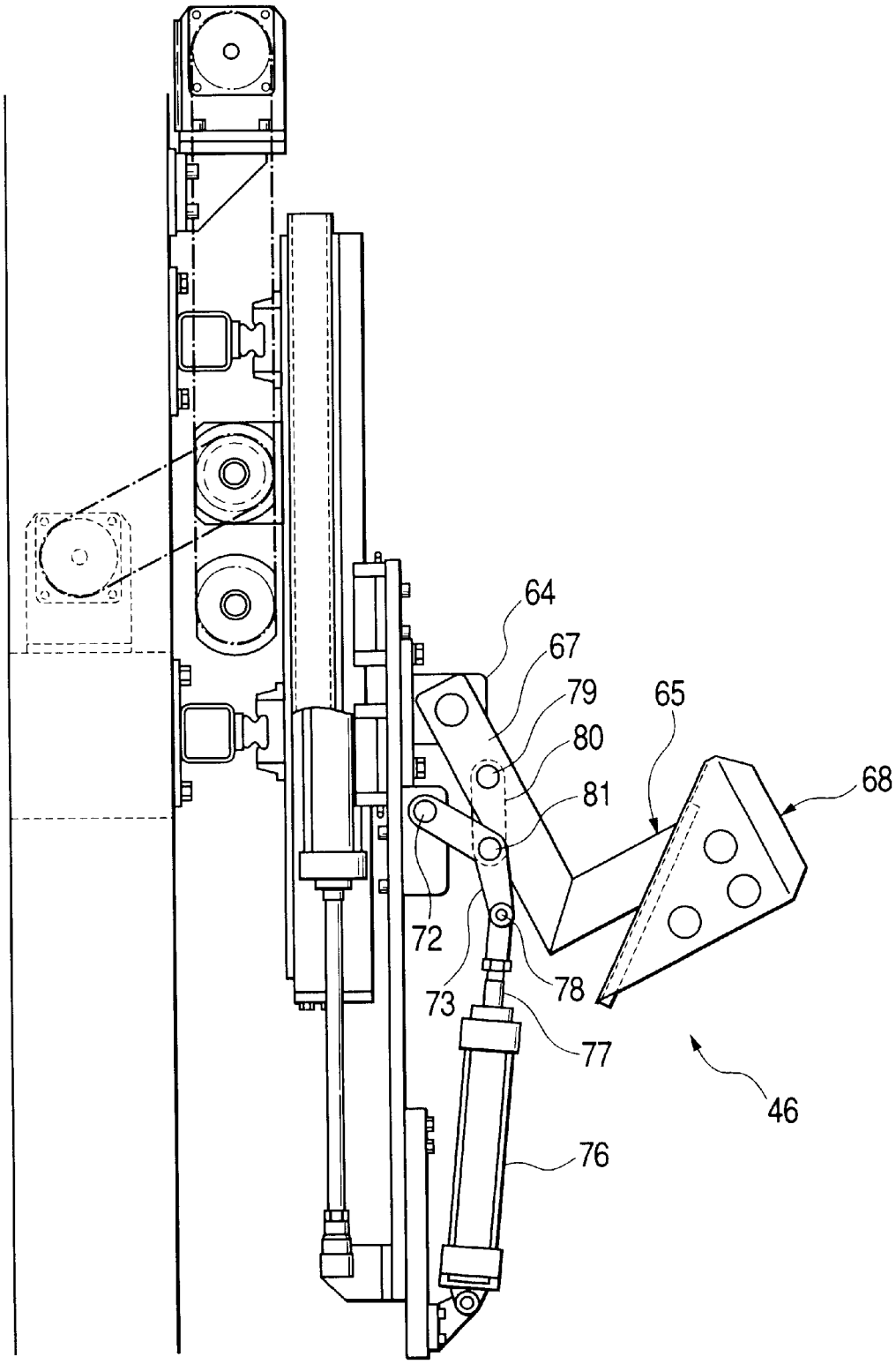
FIG. 14 is a front elevational view illustrating still another operating state of the transfer mechanism.

FIGS. 10 to 12 are enlarged views of the one transfer mechanism 46 for making up the first transfer mechanism. FIG. 10 is a front elevational view, FIG. 11 is a plan view, and FIG. 12 is a side elevational view. In addition, FIGS. 13 and 14 are front elevational views illustrating other operating states of the transfer mechanism 46. As shown in FIG. 10, the transfer mechanism 46 has a square pipe-shaped attaching member 56 arranged to be horizontally movable along the rails 50 and 51 by means of fitting members 54 and 55 fitting slidably to the rails 50 and 51. A rail 57 is vertically installed on this attaching member 56, and a lifting plate 60 is liftably installed on the attaching plate by means of fitting members 58 and 59 fitting slidably to the rail 57. This lifting plate 60 is connected by means of a connecting portion 63 to an output shaft 62 of a cylinder 61 installed on the attaching member 56, and is arranged to be liftable as the cylinder 61 is driven. A supporting arm 65 for supporting the pallet 1 by means of a bearing 64, as shown in FIG. 11, is rotatably attached to an outer surface of the lifting plate 60. This supporting arm 65 is arranged such that after a jutting-out portion 66 jutting out horizontally along the bearing 64 is interposed, the supporting arm 65 is bent orthogonally to form a rotating arm portion 67 extending horizontally, and is then bent upward, as shown in FIG. 10. A supporting portion 68 for supporting an edge portion of the pallet 1 in the tilted state is provided at its distal end. It should be noted that the jutting-out portion 66 is for allowing the supporting portion 68 to jut out to a position below the pallet 1 mounted on the tilting means 39 disposed on the carrying-in conveyor 5 when the pallet 1 is lifted up. The supporting portion 68 is formed in a U-shape, and has an inclined surface 69 for abutting against the edge portion of the tilted pallet 1 and a pair of supporting pieces 70 and 71 on both sides of the inclined surface 69, as shown in FIG. 12. The internal width between the supporting pieces 70 and 71 is set to be wider than the thickness of the pallet 1, so that the pallet 1 can be supported by being merely inserted between the supporting pieces 70 and 71, and can be also used jointly for other pallets. It should be noted that, as for the supporting of the edge portions of the pallet 1 by the transfer mechanisms, stable transfer becomes possible by supporting the pallet 1 at positions as remote from the center as possible. In addition, if the inclined surface 69 is coated with a resin or the like which is capable of reducing the frictional resistance or adhesion, when the pallet 1 is supported while staggering the timing of lifting by the two moving mechanisms 46 and 47, it is possible to smoothly proceed to a supporting state. At the same time, when the magazine 46 moves away from the pallet 1 after mounting the pallet 1 in a predetermined position, the separation of the inclined surface 69 and the edge portion of the pallet 1 can take place smoothly.

Further, a chevron-shaped drive arm 73 is rotatably attached to an outer surface of the aforementioned lifting plate 60 by means of a supporting shaft 72, and a distal end portion of the drive arm 73 is rotatably connected via a connecting pin 78 to an output shaft 77 of a cylinder 76 which is rotatably mounted via a mounting member 75 on a mounting plate 74 secured to the outer surface of the lifting plate 60. Furthermore, another end portion of a connecting member 80, which is rotatably attached via a connecting pin 79 to an intermediate portion of the rotating arm portion 67 constituting a part of the supporting arm 65, is rotatably connected via a connecting pin 81 to a bent portion at the central portion of the drive arm 73. It should be noted that an internally threaded member 84 meshing with a feed screw shaft 83, which is rotatably driven by a servo motor 82, is installed on the rear surface of the attaching member 56, and the arrangement provided is such that the horizontal movement of the transfer mechanism 46 is effected by the servo motor 82 by means of the attaching member 56.

As for the transfer mechanism 46 arranged as described above, as shown in FIG. 13, when the cylinder 61 is driven to cause the output shaft 62 to project downward from the state shown in FIG. 10, the lifting plate 60 connected to the output shaft 62 via the connecting portion 63 is lowered while being guided by the fitting of the fitting members 58 and 59 with the rail 57 laid on the attaching member 56, thereby downwardly moving the supporting portion 68 for the pallet 1. In this state, as shown in FIG. 14, if the cylinder 76 is driven this time to retract the output shaft 77, the chevron-shaped drive arm 73 connected to that output shaft 77 via the connecting pin 78 rotates downward about the supporting shaft 72. Concurrently, the rotating arm portion 67 constituting a part of the supporting arm 65 is rotated downward about the bearing 64 by means of the connecting member 80 connected via the connecting pin 81 to the bent portion at the central portion of the drive arm 73, thereby rotating the supporting portion 68 to a lower position, as shown in the drawing. As described above, the supporting portion 68 can be moved vertically by means of the lifting plate 60 by driving the cylinder 61. In addition, the supporting portion 68 can be rotated about the bearing 64 between the horizontal position and the lower position by means of the supporting arm 65 by driving the cylinder 76.

Figure 15:
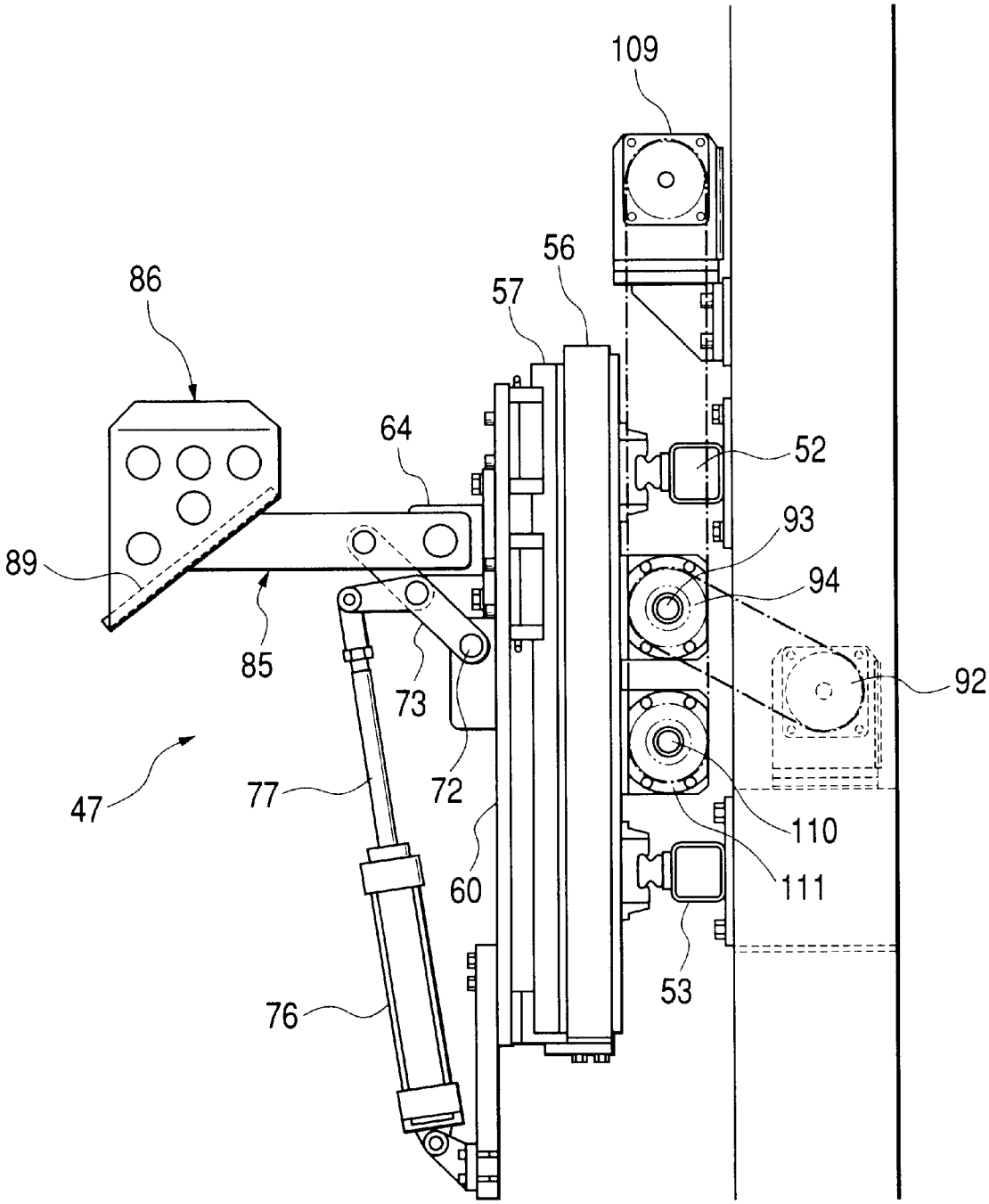
FIG. 15 is an enlarged front elevational view of the other transfer mechanism for making up the first transfer mechanism.
Figure 16:
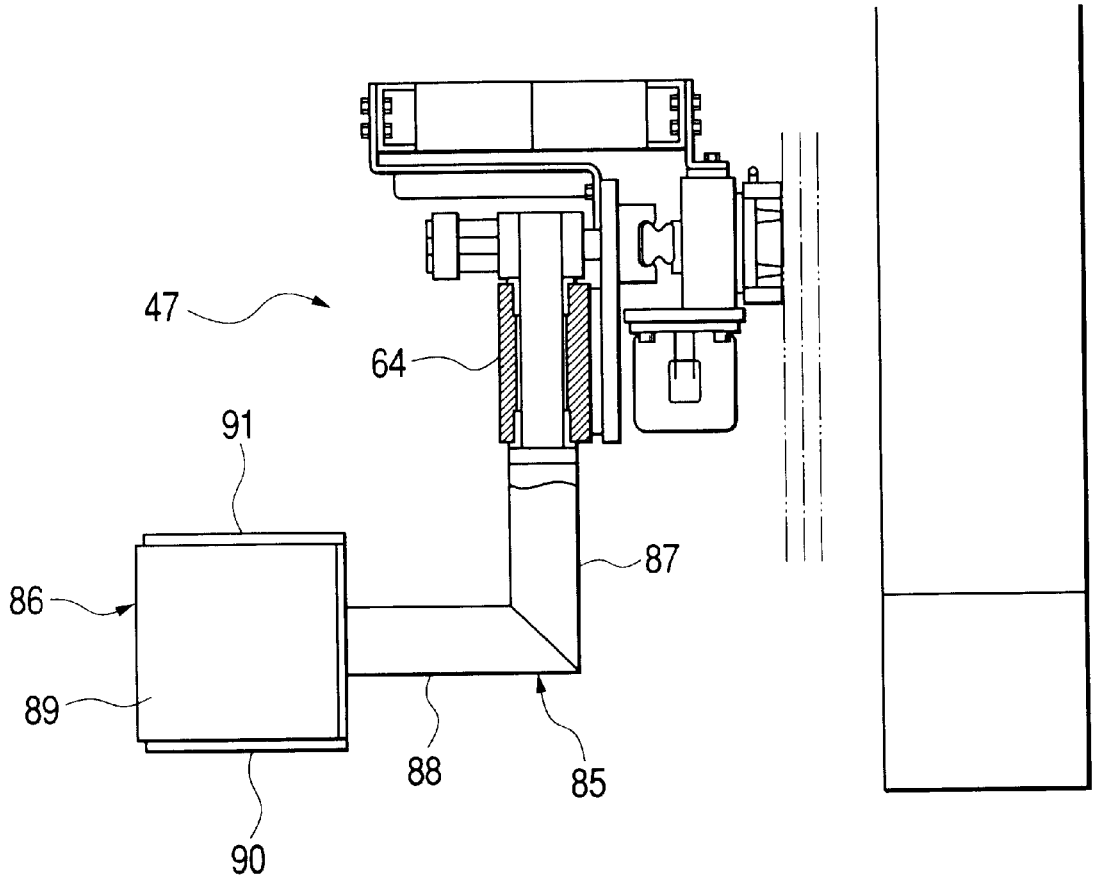
FIG. 16 is a plan view thereof.

FIG. 15 is an enlarged front elevational view of the other transfer mechanism 47 for making up the first transfer mechanism, and FIG. 16 is a plan view thereof. As shown, most portions of this other transfer mechanism 47 are arranged symmetrically with those of the above-described transfer mechanism 46. Namely, this transfer mechanism 47 is merely different in that the installation position of the rails 52 and 53 is low in view of the relationship for supporting the edge portion of the pallet 1 at a lower position than that of the above-described transfer mechanism 46 as shown in FIG. 8, and in that the shapes of a supporting arm 85 for supporting the pallet 1 and a supporting portion 86 provided at its distal end portion are different. Concerning the other portions, since arrangements symmetrical with those of the transfer mechanism 46 are adopted, and there are no basic differences in their functions, those portions are denoted by the same reference numerals, and a description thereof will be omitted. It should be noted that, as for the supporting arm 85, as shown in FIG. 16, after a jutting-out portion 87 jutting out horizontally along the bearing 64 is interposed, the supporting arm 85 is bent orthogonally to form a rotating arm portion 88 extending horizontally, and the aforementioned supporting portion 86 for supporting the edge portion of the pallet 1 in the tilted state is directly provided at a distal end of the rotating arm portion 88. The supporting portion 86 has an inclined surface 89 which abuts against the other edge portion of the tilted pallet 1 and is oriented in the opposite direction, as well as a pair of supporting pieces 90 and 91 on both sides of the inclined surface 89. As shown in FIG. 15, an internally threaded member 94 meshing with a feed screw shaft 93, which is rotatively driven by a servo motor 92, is installed on the rear surface of the attaching member 56, and the arrangement provided is such that the horizontal movement of the transfer mechanism 47 is effected by the servo motor 92.

The horizontal movement and positioning of the transfer mechanisms 46 and 47 making up the first transfer mechanism are effected by controlling the driving of the servo motors 82 and 92. Incidentally, when a cleaned pallet 1 is carried onto the tilting means 39 installed on the carrying-in conveyor 5, the transfer mechanisms 46 and 47 are retreated in advance to positions where they do not interfere with the carrying-in operation of the pallet 1. After the pallet 1 is mounted on the tilting means 39, and by timing that the pallet 1 is tilted by the cylinder 42 at a predetermined angle, the transfer mechanisms 46 and 47 are horizontally moved by the servo motors 82 and 92, and the supporting portions 68 and 86 are jutted out to positions below the pallet 1. In this case, the output shafts 62 of both cylinders 61 of the transfer mechanisms 46 and 47 are caused to project to set the-lifting plates 60 at their lowered positions, and the output shafts 77 of both or one of the cylinders 76 of the transfer mechanisms 46 and 47 are retracted, as required, which, in turn, cause the chevron-shaped drive arms 73 downward about the supporting shafts 72 and cause the supporting arms 65 and 85 to rotate downward about the bearings 64 by means of the connecting members 80. In the above-described manner, the supporting portions 68 and 86 supporting the pallet 1 jut out below the pallet 1 mounted on the tilting means 39 in a state in which the supporting portions 68 and 86 are respectively set in the lower positions.

Next, in the state in which the supporting portions 68 and 86 jut out below the pallet 1 mounted on the tilting means 39, the output shafts 77 of the cylinders 76 are caused to project to rotate both supporting arms 65 and 85 to rotate upward about the bearings 64 so as to be restored to the horizontal state. At the same time, the output shafts 62 of both cylinders 61 of the transfer mechanisms 46 and 47 are retracted to raise the lifting plates 60. It should be noted that the driving timings of the cylinders 76 and 61 may be concurrent or may be provided with a time lag. When the supporting portions 68 and 86 are raised in the above-described manner, the lower two edge portions of the pallet 1 are respectively inserted between the supporting pieces 70 and 71 and between the supporting pieces 90 and 91 and abut against the inclined surfaces 69 and 89; whereupon the pallet 1 is lifted upward from the tilting means 39 while the tilted state is being maintained. Subsequently, both servo motors 82 and 92 are driven to horizontally move both transfer mechanisms 46 and 47 making up the first transfer mechanism, and the pallet 1 as it is in the tilted state is transferred to a position above a lower holding means of the centrifugal dehydration means 10. Then, the output shafts 62 of both cylinders 61 of the transfer mechanisms 46 and 47 are caused to project to lower the lifting plates 60, and the pallet 1 as it is in the tilted state is mounted on the lower holding means of the centrifugal dehydration means 10. The output shafts 77 of both or either one of the cylinders 76 of the transfer mechanisms 46 and 47 are retracted, as required, to rotate the drive arms 73 downward about the supporting shafts 72 and cause the supporting arms 65 and 85 to rotate downward about the bearings 64 by means of the connecting members 80, thereby retreating the supporting shafts 68 and 86 so as not to cause a hindrance. At the same time, the upper portion of the pallet 1 is supported by an upper holding means. Subsequently, both servo motors 82 and 92 are driven to horizontally move both transfer mechanisms 46 and 47, so that the transfer mechanisms 46 and 47 are retreated to positions where they do not interfere with the dehydration operation by the centrifugal dehydration means 10, and remain on standby until the ensuing operation.

Figure 17:
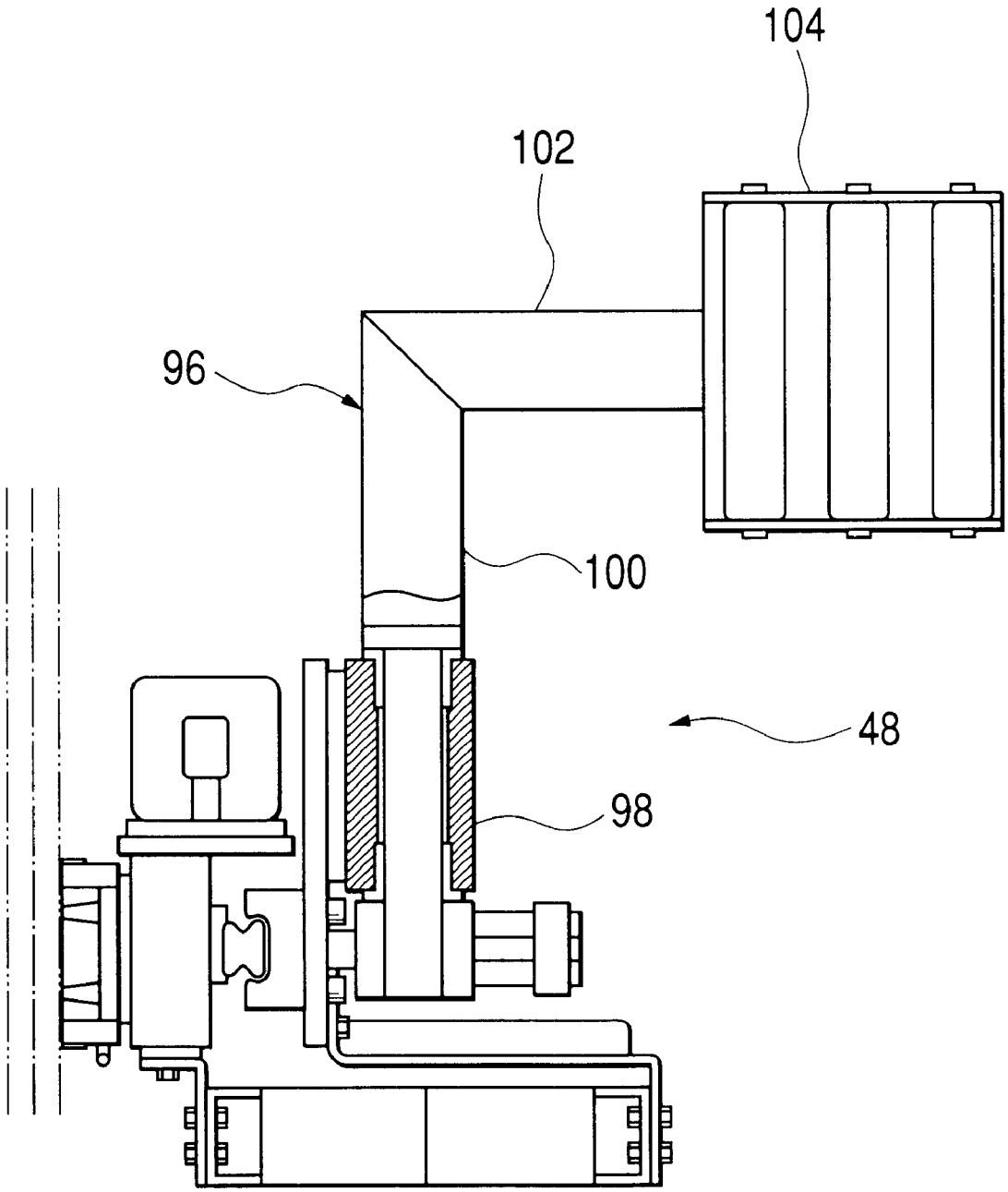
FIG. 17 is an enlarged plan view of one transfer mechanism for making up a second transfer mechanism.
Figure 18:
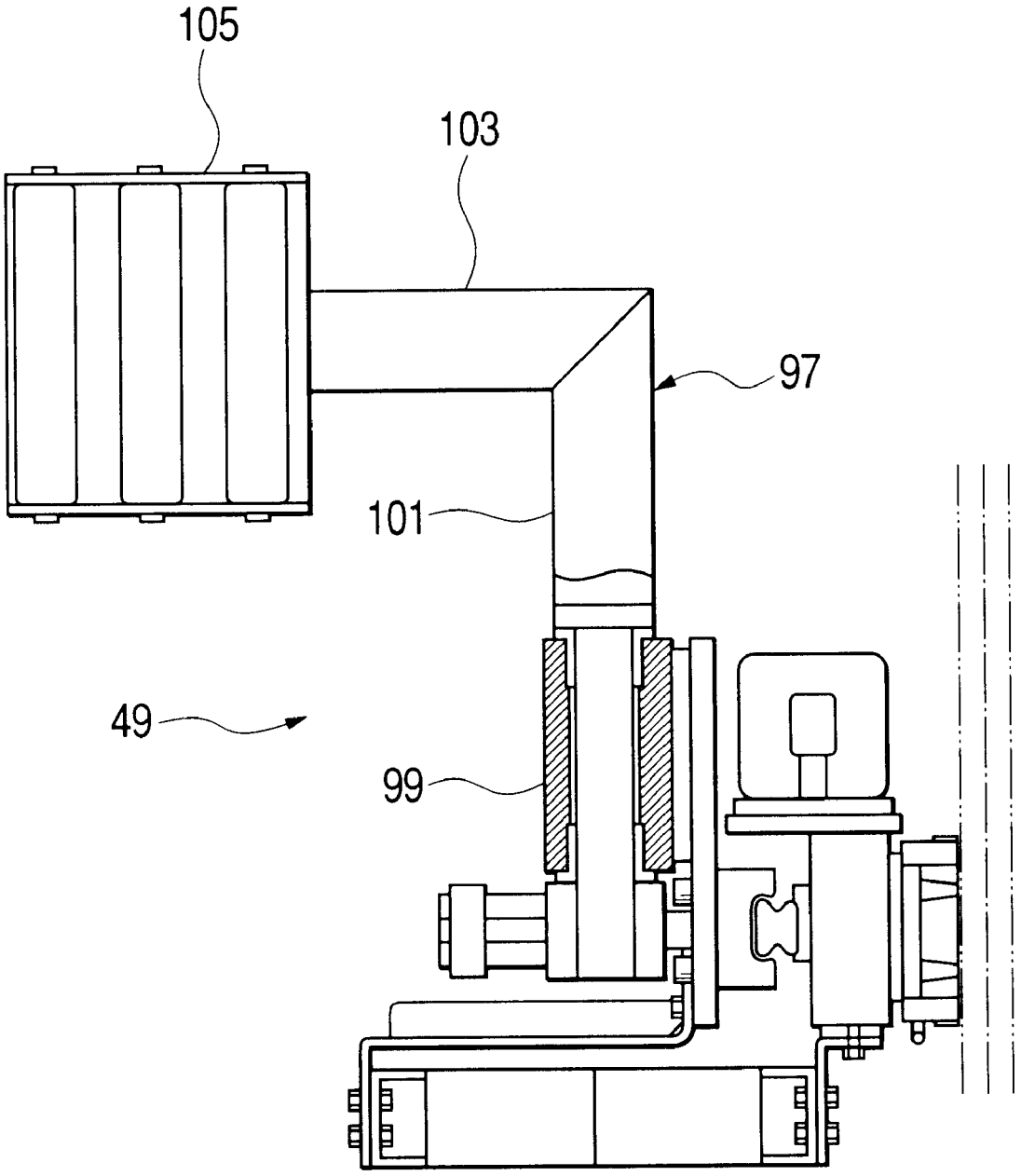
FIG. 18 is an enlarged plan view of the other transfer mechanism for making up a second transfer mechanism.

Next, a description will be given of the second transfer mechanism for transferring the pallet 1 after dehydration as it is in the tilted state from the centrifugal dehydration means 10 to the carrying-out conveyor 11. FIGS. 17 and 18 illustrate the second transfer mechanism, in which FIG. 17 is an enlarged plan view of one transfer mechanism 48 for making up the second transfer mechanism, and FIG. 18 is an enlarged plan view of the other transfer mechanism 40. As shown in FIG. 9, these transfer mechanisms 48 and 49 making up the second transfer mechanism are horizontally moved in directions opposite to the directions of the transfer mechanisms 46 and 47 making up the first transfer mechanism, and the pallet 1 subjected to dehydration processing is delivered to a tilt restoring means 95 consisting of a mechanism similar to that of the above-described tilting means 39 and adapted to receive the pallet 1 in the tilted state, restore it to the upright state, and mount it on the carrying-out conveyor 11. Accordingly, when delivering the pallet 1 subjected to dehydration processing to the tilt restoring means 95, the supporting portions for supporting the pallet 1 in the transfer mechanisms 48 and 49 need to jut out in directions opposite to the directions of the transfer mechanisms 46 and 47 making up the first transfer mechanism. For this reason, as shown in FIGS. 17 and 18, supporting arms 96 and 97 of the transfer mechanisms 48 and 49 are arranged such that after jutting-out portions 100 and 101 jutting out horizontally in directions opposite to the cases of the transfer mechanisms 46 and 47 along bearings 98 and 99 are interposed, the supporting arms 96 and 97 are bent orthogonally to form rotating arm portions 102 and 103 extending horizontally. Further, supporting portions 104 and 105 for supporting the edge portions of the pallet 1 in the tilted state are provided at their distal ends. The transfer mechanisms 48 and 49 making up the second transfer mechanism differ from the transfer mechanisms 46 and 47 making up the first transfer mechanism in the following aspects: First, the directions in which the aforementioned supporting portions 104 and 105 jut out are different. Secondly, although, in the case of the transfer mechanisms 46 and 47 making up the first transfer mechanism, since the pallet 1 is in a state of being wet with the cleaning liquid, even if portions of contact with the edge portions of the pallet 1 are merely the inclined surfaces 69 and 89, the supporting portions 68 and 86 can be easily separated from the pallet 1, in the case of the second transfer mechanism, the liquid has been removed from the surfaces of the pallet 1; and separation is difficult, it is necessary to devise a measure so that a frictional force is not applied to the portions of contact with the edge portions of the pallet 1 in the supporting portions 104 and 105 by providing rollers or the like as in shown in the drawings. In the other basic arrangements, however, there are no differences with the transfer mechanisms 46 and 47 making up the first transfer mechanism, and the transfer mechanisms 48 and 49 making up the second transfer mechanism are provided with similar functions. Incidentally, reference numeral 106 shown in FIG. 10 denotes a servo motor for driving one transfer mechanism 48 for making up the above-described second transfer mechanism, and the arrangement provided is such that the transfer mechanism 48 is moved horizontally by means of a feed screw shaft 107 and an internally threaded member 108 which are rotatively driven by that servo motor 106. In addition, reference numeral 109 shown in FIG. 15 denotes a servo motor for driving the other transfer mechanism 49 for making up the above-described second transfer mechanism, and the arrangement provided is such that the transfer mechanism 49 is moved horizontally by means of a feed screw shaft 110 and an internally threaded member 111 which are rotatively driven by that servo motor 109.

Figure 19:
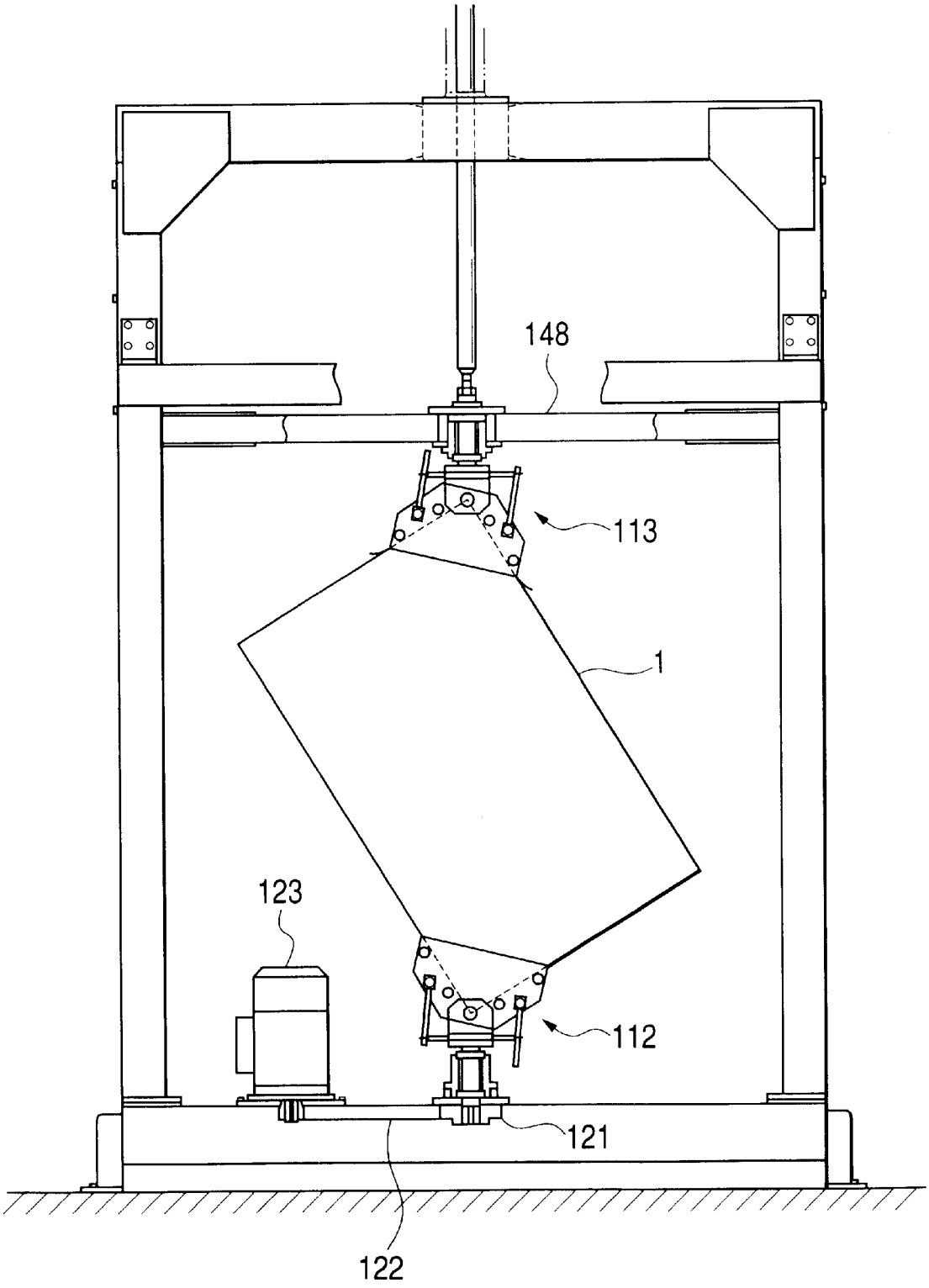
FIG. 19 is a front elevational view illustrating the portion of a centrifugal dehydration means.
Figure 20:
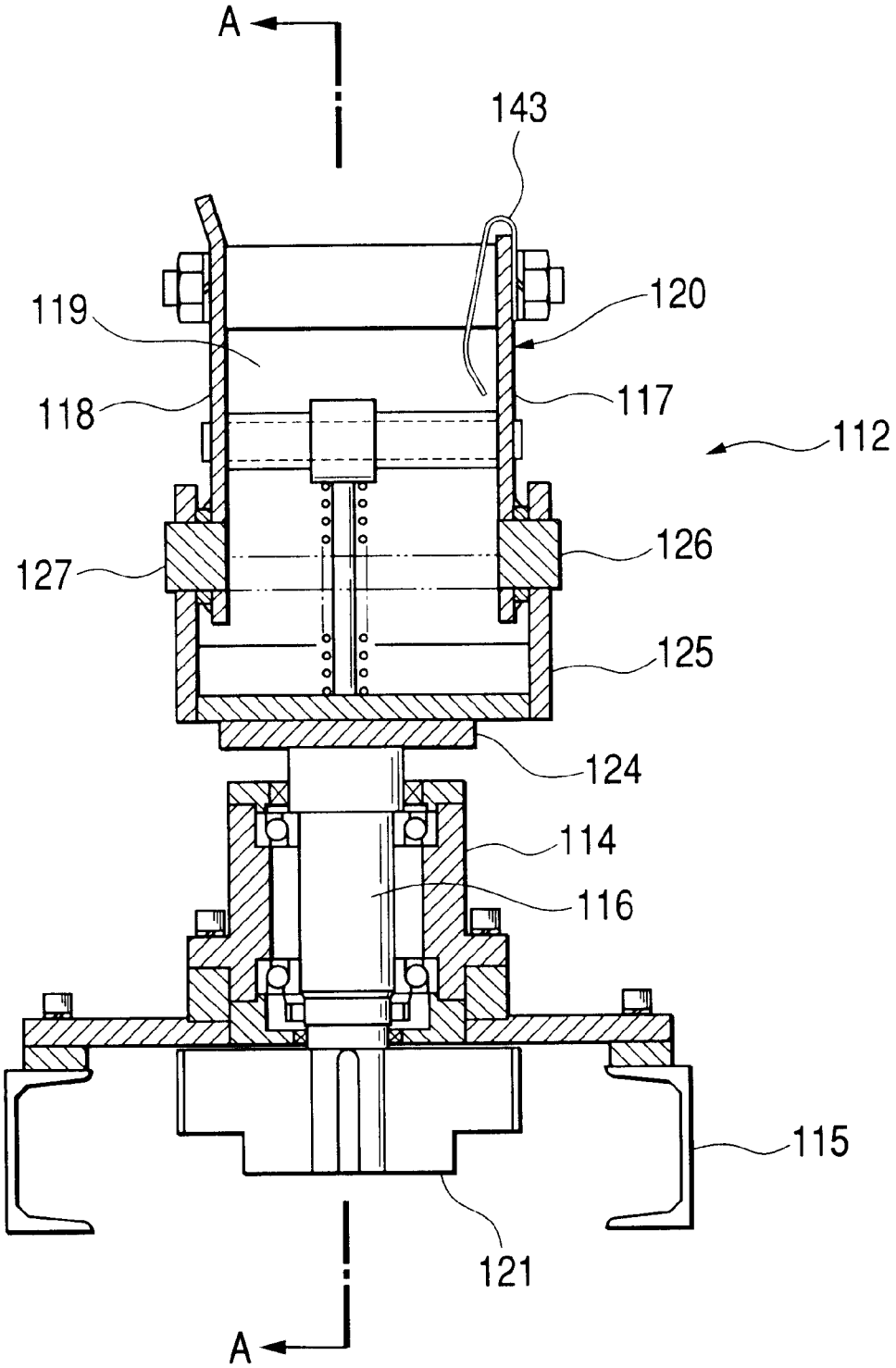
FIG. 20 is an enlarged vertical cross-sectional view of a lower holding means for holding a lower corner portion of the pallet.
Figure 21:
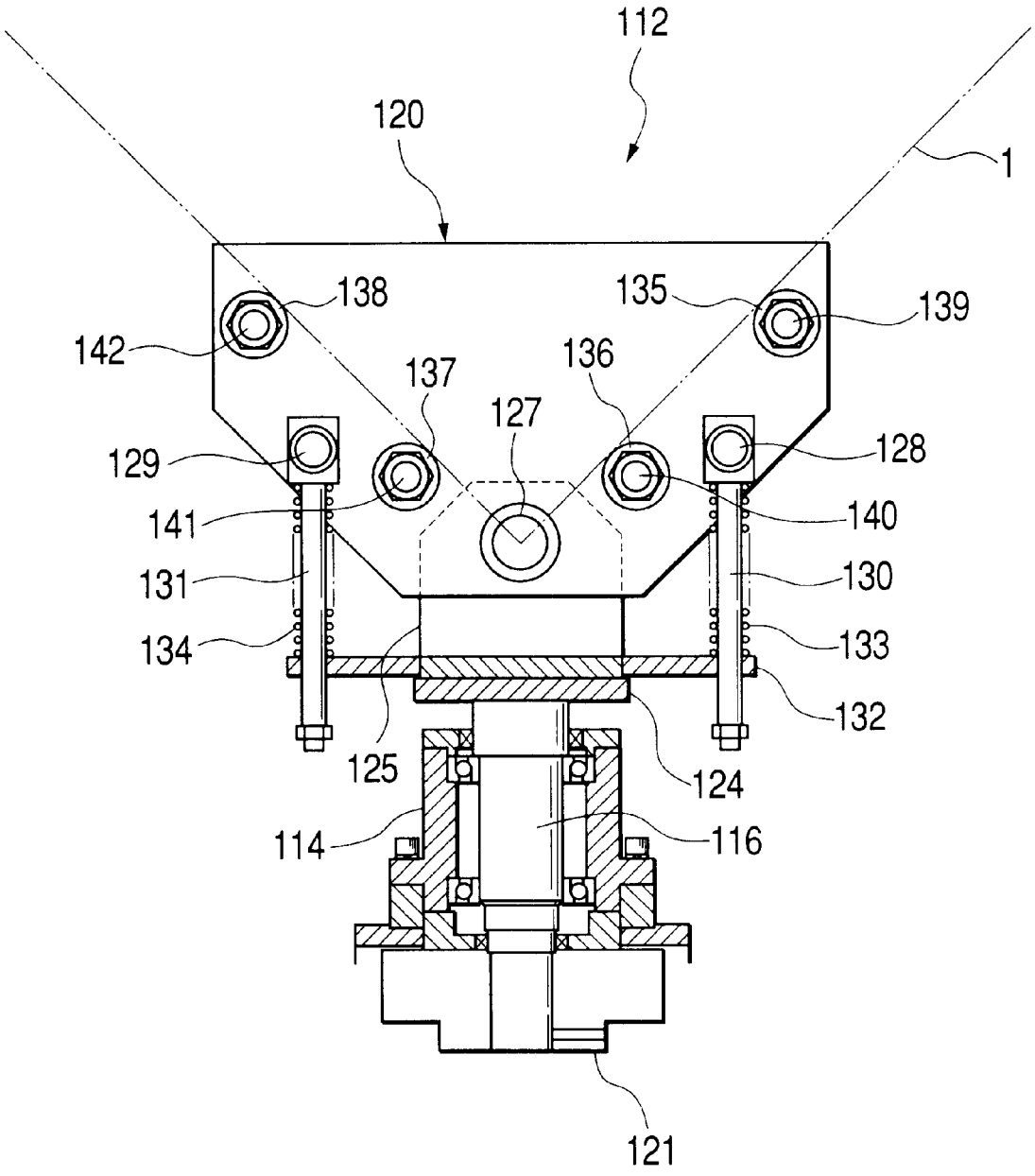
FIG. 21 is a cross-sectional view taken along line A—A of FIG. 20.

Next, a description will be given of the above-described centrifugal dehydration means 10. As shown in FIG. 9, the centrifugal dehydration means 10 is disposed substantially in a central portion of the dehydration chamber 9. FIG. 19 is a front elevational view illustrating the portion of this centrifugal dehydration means 10. As shown in the drawing, the centrifugal dehydration means 10 has a lower holding means 112 and an upper holding means 113 for supporting diagonal corner portions of the pallet 1, and effects centrifugal dehydration processing while by rotating while supporting the pallet 1 in the tilted state by these holding means 112 and 113. FIG. 20 is an enlarged vertical cross-sectional view of the lower holding means 112, and FIG. 21 is a cross-sectional view taken along line A—A thereof. As shown in the drawings, the lower holding means 112 consists of a rotating shaft 116 which is rotatably supported by an apparatus frame 115 by means of a bearing 114, as well as a corner holding portion 120 which is formed by two side plates 117 and 118 disposed on an upper portion of the rotating shaft 116 and in which an accommodating space 119 is formed into which the corner portion of the pallet 1 can be inserted between the side plates 117 and 118. A drive wheel 121 such as a gear is secured to a lower portion of the rotating shaft 116, which is arranged to be rotatively driven by a motor 123 with a brake by means of a toothed belt 122 or the like, as shown in FIG. 19. Incidentally, if an arrangement is provided such that, at the time of centrifugal dehydration, the rotating direction of the rotating shaft 116 is changed over between the forward and reverse directions so as to change over the rotating direction of the pallet 1, the arrangement is very effective in terms of the dehydration effect.

As shown in FIGS. 20 and 21, a substantially U-shaped connecting member 125 is secured to the upper portion of the rotating shaft 116 by means of an end plate 124 formed integrally with the rotating shaft 116, and the corner holding portion 120 is rotatably connected to that connecting member 125 by means of connecting pins 126 and 127 on both sides. Further, resilient members 133 and 134 such as springs are disposed between the corner holding portion 120 and a supporting plate 132 attached to the connecting member 125 side, such that the resilient members 133 and 134 are respectively fitted over rods 130 and 131 pivotally secured to supporting shafts 128 and 129 passed through the corner holding portion 120, thereby constantly urging the corner holding portion 120 so as to return to the horizontal state shown in FIG. 21. It should be noted that, in this embodiment, as described above, the corner holding portion 120 is rotatably connected to the aforementioned substantially U-shaped connecting member 125 by using the connecting pins 126 and 127 on both sides, and the space is thereby formed into which the corner portion of the pallet 1 can be inserted between these connecting pins 126 and 127. Thus the arrangement is provided such that the apex portion of the corner portion can be aligned with the rotational center of the corner holding portion 120. However, it is also possible to provide an arrangement in which, as indicated by the two-dot chain lines in FIG. 20, by using one supporting shaft, an intermediate portion of the supporting shaft is notched into a semicircular shape, thereby allowing the apex portion of the corner portion to be aligned with the rotational center of the corner holding portion 120. Further, supporting shafts 139 to 142, over which cylindrical rollers 135 to 138 are respectively fitted rotatably, are installed by being passed through the corner holding portion 120 and are respectively fixed by nuts. Incidentally, the supporting shafts 139 to 142 are positioned such that an intersection between a plane connecting abutting portions of the cylindrical rollers 135 to 136, against which the pallet 1 abut, and a plane connecting abutting portions of the cylindrical rollers 137 and 138 is aligned with the centers of the connecting pins 126 and 127. Namely, the supporting shafts 139 to 142 are positioned such that the apex portion of the corner portion of the pallet 1 is aligned with the centers of the connecting pins 126 and 127 when the pallet 1 is supported by the cylindrical rollers 135 to 138. It should be noted that a pressing and supporting member 143 serving as a resilient clamping means is provided on the inner side of the corner holding portion 120 to cope with a change in the thickness of the pallet 1, as shown in FIG. 20, so that the pallet 1 will not become shaky in its thickness wise direction.

Figure 22:
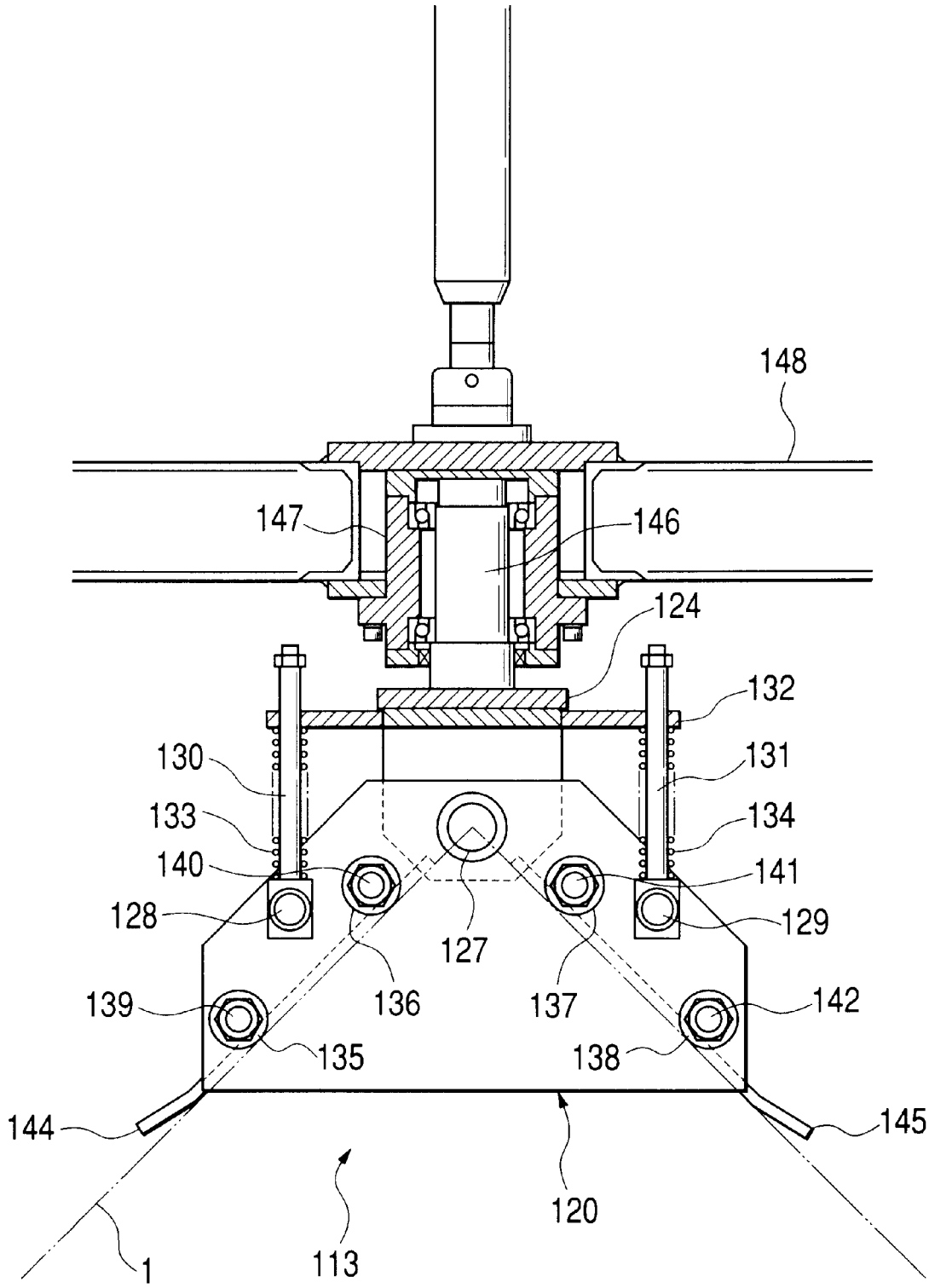
FIG. 22 is an enlarged vertical cross-sectional view illustrating an upper holding means for holding an upper corner portion of the pallet.

FIG. 22 is an enlarged vertical cross-sectional view illustrating the upper holding means 113 for holding an upper corner portion of the pallet 1. As shown, as for the upper holding means 113, since arrangements similar to those of the above-described lower holding means 112 are adopted except that guide plates 144 and 145 for guiding the pallet 1 are provided and that a rotating shaft 146 is supported by a bearing 147 so as to be capable of rotating in conjunction with the rotation of the pallet 1, the component parts will be denoted by the same reference numerals and a description thereof will be omitted. Incidentally, the guide plates 144 and 145 are useful such as when the upper corner portion of the pallet 1 mounted on the lower holding means 112 and having a different size or aspect ratio, in particular, is guided into and held onto the upper holding means 113.

The pallet 1 transferred in the tilted state to a position above the lower holding means 112 by the transfer mechanisms 46 and 47 making up the first transfer mechanism is mounted with its lower corner portion inserted in the corner holding portion 120, and is mounted as it is in the tilted state. At this point of time, the corner holding portion 120 maintains a substantially horizontal state by virtue of the resilient action of the aforementioned resilient members 133 and 134. In due course of time, if a supporting frame 148 or the portion of the rotating shaft 116 is lowered by an appropriate method, and the upper holding means 113 is lowered, the corner portion of the upper portion of the pallet 1 is guided into the corner holding portion 120 by the guide plates 144 and 145. In this case, in a case where the pallet 1 is square, the upper corner portion is guided into the corner holding portion 120 in a state in which the pallet 1 remains substantially in the tilted state. However, in a case where the pallet 1 is rectangular, the upper corner portion is guided into the corner holding portion 120 while gradually changing the tilted state such that the vertical diagonal line approaches the center of rotation which connects the lower holding means 112 and the upper holding means 113. If the upper holding means 113 is further lowered, as the edge portion of the pallet 1 and the cylindrical rollers 135 and 136 or 137 and 138 abut against each other, both corner holding portions 120 of the lower holding means 112 and the upper holding means 113 are tilted by overcoming the resiliency of the resilient members 133 and 134 to allow the edge portions of the pallet 1 and the cylindrical rollers 135 and 136 and 137 and 138 to be brought into close contact with each other. Consequently, the diagonal line of the pallet 1 is set on the rotating shaft 116, and stable centrifugal dehydration in which the amount of runout is small becomes possible. As described above, in various component parts of this pallet cleaning apparatus, joint use of the apparatus becomes possible.

Next, a description will be given of the results of an experiment on the dehydration effect which was conducted by using the above-described centrifugal dehydration means 10. In experiment 1, with respect to a resin-made pallet after effecting ordinary water cleaning using the above-described centrifugal dehydration means 10, changes in the dehydration effect were examined according to the presence or absence of the changeover between forward and reverse rotation and the frequency of changeover in the case where the change over was effected alternately at 5-second intervals. Incidentally, the rotational speed of the pallet was set to. 450 rpm. However, as for the rise concerning the rotational speed of the pallet at the time of the changeover between forward and reverse rotation, it took an acceleration time of 3 seconds or thereabouts until the target of 450 rpm was reached. Table 1 shows the results of the above-described experiment 1. It should be noted that the number of drops of water in the table shows the number of drops of water counted in a case where the pallet subjected to dehydration processing was placed on corrugated cardboard, and the number of drops of water adhered to the surface of the corrugated cardboard was counted at that time. In this case, the number of drops of water in which drops of water remaining inside the pallet moved round to the pallet surface through openings or the like formed in the mounting surface was also counted. From the results of this experiment 1, it became clear that the dehydration effect can be improved substantially if the changeover between forward and reverse rotation is effected even once as compared with the case where the changeover is not effected at all. In addition, it became clear that if the frequency of changeover between forward and reverse rotation is set to two or more, it is possible to obtain substantially satisfactory dehydration results which are free of problems in the actual use in the state persisting after centrifugal dehydration. In particular, it became clear that in the case where the frequency of changeover between forward and reverse rotation is set to three or more so that the pallet is rotated at least twice each in the forward and reverse directions, even more favorable dehydration results can be obtained stably.

TABLE 1

| Method of Rotation of Pallet | | Number of Water Drops Attached to Corrugated Cardboard | State of Draining off Surface | State of Draining of Interior |
|---|---|---|---|---|
| No changeover between Forward (F) and Reverse (R) | | 15 | slightly wet state | a state in which 4 or 5 water drops are present in one recessed portion on the rear side in the forwardly rotating direction |
| Changeover between F and R: 1 | F → R | 8 | considerably dry state | a state in which 1 or 2 water drops are present in one recessed portion on the front side in the reversely rotating direction |
| Changeover between F and R: 2 | F → R → F | 5 | substantially Dry state | a state in which water drops are practically nil |
| Changeover between F and R: 3 | F → R → F → R | 4 | substantially Dry state | a state in which water drops are practically nil and the condition is more satisfactory |
| Changeover between F and R: 5 | F → R → F → R → F → R | 3 | substantially Dry state | a state in which water drops are practically nil and the condition is more satisfactory |
| Changeover between F and R: 9 | F → R → F → R → F → R → F → R → F → R | 3 | well dry state | a state in which water drops are practically nil and the condition is more satisfactory |

Forward: forwardly rotated for 5 seconds
Reverse: reversely rotated for 5 seconds In experiment 2, by using the same apparatus as that of the above-described experiment 1, changes in the dehydration effect were examined in a case where the interval of changeover between forward and reverse rotation was varied in a state in which the frequency of changeover between forward and reverse rotation was set to 3 so that the pallet is rotated twice each in the forward and reverse directions. It should be noted that the rotational speed of the pallet was set to 450 rpm in the same way as in experiment 1. Table 2 shows the results of the above-described experiment 2. The number of drops of water in the table shows the number of drops of water counted in the case where the number of drops of water adhered to the surface of the corrugated cardboard was counted when the pallet subjected to dehydration processing was placed on the corrugated cardboard, in the same way as experiment 1. From the results of this experiment 2, it became clear that even if the interval of changeover between forward and reverse rotation is varied, there is not much difference in the dehydration effect in practical use. Namely, it became clear that if the frequency of changeover between forward and reverse rotation is set to an appropriate number, a more efficient dehydration effect can be obtained by setting the interval of changeover between forward and reverse rotation to a short duration.

TABLE 2

| Method of Rotation of Pallet | | Number of Water Drops Adhered to Corrugated Cardboard |
|---|---|---|
| Changeover between forward and reverse: 3 | F → R → F → R operated for 5 seconds each | 4 |
| Changeover between forward and reverse: 3 | F → R → F → R operated for 10 seconds each | 4 |

TABLE 2-continued

| Method of Rotation of Pallet | | Number of Water Drops Adhered to Corrugated Cardboard |
|---|---|---|
| Changeover between forward and reverse: 3 | F → R → F → R operated for 15 seconds each | 3 |
| Changeover between forward and reverse: 3 | F → R → F → R operated for 30 seconds each | 3 |

In experiment 3, by using the same apparatus as that of the above-described experiment, changes in the dehydration effect were examined in the case where the rotational speed of the pallet was varied in the state in which the frequency of changeover between forward and reverse rotation was set to 3 so that the pallet is rotated twice each in the forward and reverse directions. Table 3 shows the results of the above-described experiment 3. The number of drops of water in the table shows the number of drops of water counted in the case where the number of drops of water adhered to the surface of the corrugated cardboard was counted when the pallet subjected to dehydration processing was placed on the corrugated cardboard, in the same way as experiment 1. The mark "○" shows a state in which most of the drops of water were removed, while the mark "Δ" shows a state in which the drops of water were noticeable. From the results of this experiment 3, it became clear that if the rotational speed of the pallet is set to 350 rpm or more, a satisfactory dehydration effect can be obtained in view of both the number of drops of water remaining on the obverse surfaces and the state of draining on the side surfaces or the inner surfaces.

TABLE 3

| Rotational Speed of Pallet (rpm) | Number of Water Drops Adhered to Corrugated Cardboard | State of Draining | | |
|---|---|---|---|---|
| | | Obverse surface | Side surface | Inner Surface |
| 450 | 3 | ○ | ○ | ○ |
| 400 | 3 | ○ | ○ | ○ |
| 350 | 4 | ○ | ○ | ○ |
| 300 | 8 | Δ | ○ | Δ |
| 250 | 20 | Δ | ○ | Δ |

As described above, it became clear from experiments 1 to 3 that if the changeover between forward and reverse rotation is effected even once, the dehydration effect can be improved substantially as compared with the case of no changeover. In addition, concerning the frequency of changeover between forward and reverse rotation, it became clear that if it is set to two or more, it is possible to obtain substantially satisfactory dehydration results which are free of problems in the actual use in the state persisting after centrifugal dehydration. In addition, as for the interval of changeover between forward and reverse rotation, it became clear that even if it is set to a long duration, the dehydration effect is not improved much. Accordingly, if the interval of changeover between forward and reverse rotation is set to as short a duration as possible within a range that does not impose strains on the apparatus and the like, a more efficient dehydration operation is possible. Furthermore, concerning the rotational speed of the pallet, it became clear that if it is set to 350 rpm or more, a satisfactory dehydration effect can be obtained.

In the invention, since the arrangement provided is such that the pallet or the like is rotated while being held on its diagonal line, the center of gravity of the pallet or the like is situated on the axis of rotation. Hence, the runout due to the centrifugal force can be suppressed easily and accurately. Accordingly, even if the apparatus is rotated at high speed, safety can be ensured, and the efficiency of operation can be improved. In addition, since the pair of corner portions on the diagonal line are held, the center of gravity of the pallet or the like can be easily aligned with the axis of rotation, it is possible to accurately overcome the positional offset during the rotation of the pallet or the like.

The invention is not limited at all to the description of the mode for carrying out the invention and the description of the embodiments. The invention includes various modifications that can be conceived easily by those skilled in the art, without departing from the description of the scope of claim.

What is claimed is:

1. A method for centrifugally dehydrating a workpiece with a substantially rectangular plane, comprising steps of:

holding said workpiece on one diagonal line of the substantially rectangular plane of said workpiece; and rotating said workpiece substantially in a state where the diagonal line is substantially aligned with an axis of rotation, thereby removing a liquid adhered to said workpiece.

2. A method according to claim 1, wherein a direction of rotation of said workpiece is changed over between forward rotation and reverse rotation.

3. A method according to claim 2, wherein the changeover of the direction of rotation between forward rotation and reverse rotation is effected at least two times or more.

4. A method according to claim 1, wherein after said workpiece is subjected to cleaning in an upright state such that one edge thereof is set as a bottom, said workpiece is tilted such that a corner portion thereof is set as a bottom, and centrifugal dehydration is effected in the tilted state.

5. An apparatus for centrifugally dehydrating a workpiece with a substantially rectangular plane, comprising:

a pair of holders for respectively holding a pair of corner portions of said work piece on a diagonal line of the substantially rectangular plane of said workpiece; and a rotator for rotating said pair of holders together with said workpiece, wherein said workpiece is rotated while being held by said pair of holders such that the diagonal line of said workpiece is substantially aligned with an axis of rotation, thereby removing a liquid adhered to said workpiece.

6. An apparatus according to claim 5, wherein a direction of rotation of said workpiece is changed over between forward rotation and reverse rotation.

7. An apparatus according to claim 6, wherein the changeover of the direction of rotation between forward rotation and reverse rotation is effected at least two times or more.

8. An apparatus according to claim 5, wherein after said workpiece is subjected to cleaning in an upright state such that one edge thereof is set as a bottom, said workpiece is tilted such that a corner portion thereof is set as a bottom, and centrifugal dehydration is effected in the tilted state.

9. An apparatus according to claim 5, wherein said pair of holders are each arranged to be capable of tilting in correspondence with abutment against two adjacent edge portions with each of the corner portions located therebetween when the pair of corner portions of said workpiece are respectively held by said pair of holders.

10. An apparatus according to claim 5, further comprising:

a supporting mechanism for supporting the two edge portions with the corner portion of a bottom of said workpiece located therebetween; and a transfer mechanism for transferring said supporting mechanism.

* * * * *